US010407200B2

(12) United States Patent
Banno et al.

(10) Patent No.: US 10,407,200 B2
(45) Date of Patent: Sep. 10, 2019

(54) LABEL MEDIUM AND CASSETTE

(71) Applicant: Brother Kogyo Kabushiki Kaisha, Nagoya-shi, Aichi-ken (JP)

(72) Inventors: Takaaki Banno, Nagoya (JP); Yukiko Takami, Inazawa (JP); Harumitsu Inoue, Toki (JP); Haruki Matsumoto, Nagoya (JP); Yukihiko Sato, Nagoya (JP); Takaaki Oguchi, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/939,851

(22) Filed: Mar. 29, 2018

(65) Prior Publication Data

US 2019/0001713 A1 Jan. 3, 2019

(30) Foreign Application Priority Data

Jun. 30, 2017 (JP) ..... 2017-129493

(51) Int. Cl.
*B41J 15/04* (2006.01)
*B41J 2/32* (2006.01)
(Continued)

(52) U.S. Cl.
CPC ..... *B65C 9/1865* (2013.01); *B41J 2/32* (2013.01); *B41J 15/044* (2013.01);
(Continued)

(58) Field of Classification Search
CPC ..... B41J 15/044; B41J 2/32; B41J 3/4075; B65C 9/10; B65C 9/1865; B65C 9/1892;
(Continued)

(56) References Cited

U.S. PATENT DOCUMENTS 280,086 A 6/1883 Scharnweber
2,642,684 A 6/1953 Watts
(Continued)

FOREIGN PATENT DOCUMENTS

DE 202004003107 U1 4/2004
EP 2833341 A1 2/2015
(Continued)

OTHER PUBLICATIONS

Feb. 14, 2018—Co-pending U.S. Appl. No. 15/896,191.
(Continued)

*Primary Examiner* — Kristal Feggins
*Assistant Examiner* — Kendrick X Liu
(74) *Attorney, Agent, or Firm* — Banner & Witcoff, Ltd.

(57) ABSTRACT

A label of a label medium includes: first and second indicator portions each having an information-printable region; first and second wrapping portions to be wrapped on a wrapped member; and first and second through portions through which the first and second indicator portions are passed. The first and second indicator portions are arranged in this order in a first direction and connected to each other via a first line. The second indicator portion, the second wrapping portion, and the second through portion are connected to each other and arranged in this order in the first direction, The first wrapping portion and the first through portion are arranged in this order in the first direction or a second direction. The first wrapping portion and the second wrapping portion, and/or the first through portion and the second through portion are connected to each other via a second line.

19 Claims, 8 Drawing Sheets

(51) Int. Cl.

| | |
|---|---|
| ***B41J 3/407*** | (2006.01) |
| ***B65C 9/18*** | (2006.01) |
| ***G09F 3/00*** | (2006.01) |
| ***G09F 3/04*** | (2006.01) |
| ***G09F 3/20*** | (2006.01) |
| *G09F 3/02* | (2006.01) |

(52) U.S. Cl.
CPC ..... *B65C 9/1892* (2013.01); *G09F 3/005* (2013.01); *G09F 3/0289* (2013.01); *G09F 3/0295* (2013.01); *G09F 3/04* (2013.01); *G09F 3/205* (2013.01); *B41J 3/4075* (2013.01); *G09F 2003/0201* (2013.01); *G09F 2003/0202* (2013.01)

(58) Field of Classification Search
CPC ..... G09F 3/02; G09F 2003/0201; G09F 2003/0202; G09F 3/04
See application file for complete search history.

(56) References Cited

U.S. PATENT DOCUMENTS

| | | | | |
|---|---|---|---|---|
| 3,197,830 | A | 8/1965 | Hoadley | |
| 3,757,936 | A | 9/1973 | Lindegren | |
| 4,004,362 | A | 1/1977 | Barbieri | |
| 4,916,841 | A | 4/1990 | Dawson | |
| 5,145,211 | A | 9/1992 | McKillip | |
| 5,381,617 | A | 1/1995 | Schwartztol et al. | |
| 8,074,389 | B2 | 12/2011 | Greer et al. | |
| 9,355,577 | B1 | 5/2016 | Coleman et al. | |
| 9,539,832 | B2 | 1/2017 | Sasaki | |
| 2004/0068906 | A1* | 4/2004 | Riley | B42D 15/00 40/633 |
| 2004/0194360 | A1 | 10/2004 | McCabe et al. | |
| 2004/0237368 | A1 | 12/2004 | Paskesen et al. | |
| 2005/0126701 | A1 | 6/2005 | Hodsdon et al. | |
| 2005/0204594 | A1 | 9/2005 | Savagian et al. | |
| 2005/0268435 | A1 | 12/2005 | Moughelbay et al. | |
| 2005/0279001 | A1* | 12/2005 | Riley | B42D 15/00 40/633 |
| 2006/0057325 | A1 | 3/2006 | Hodsdon et al. | |
| 2008/0120881 | A1 | 5/2008 | Rhinehart et al. | |
| 2008/0301981 | A1 | 12/2008 | Giro Amigo | |
| 2010/0281724 | A1* | 11/2010 | Greer | G09F 3/005 40/633 |
| 2010/0313454 | A1 | 12/2010 | Smith, Jr. et al. | |
| 2013/0180138 | A1 | 7/2013 | Luea | |
| 2013/0260991 | A1 | 10/2013 | Van Boom et al. | |
| 2015/0027579 | A1 | 1/2015 | Campbell et al. | |
| 2015/0251464 | A1* | 9/2015 | Kubota | G09F 3/0295 347/104 |
| 2016/0297217 | A1 | 10/2016 | Sasaki | |
| 2018/0015739 | A1 | 1/2018 | Sun | |
| 2018/0015742 | A1 | 1/2018 | Inoue et al. | |
| 2018/0015748 | A1 | 1/2018 | Kato et al. | |

FOREIGN PATENT DOCUMENTS

| | | | |
|---|---|---|---|
| EP | 2977218 | A1 | 1/2016 |
| EP | 3075804 | A1 | 10/2016 |
| JP | 2013111756 | A | 6/2013 |
| JP | 2017-064925 | A | 4/2017 |
| WO | 2010129131 | A1 | 11/2010 |
| WO | 2017038585 | A1 | 3/2017 |

OTHER PUBLICATIONS

Mar. 29, 2018—Co-pending U.S. Appl. No. 15/939,917.
Oct. 10, 2018—U.S. Non-Final Office Action—U.S. Appl. No. 15/896,191.
Oct. 17, 2018—(EP) Partial Search Report—App 18160624.5.
Feb. 14, 2019—(EP) Extended Search Report—App 18160624.5.
May 31, 2019—(U.S.) Notice of Allowance—U.S. Appl. No. 15/896,191.

* cited by examiner

LABEL MEDIUM AND CASSETTE

CROSS REFERENCE TO RELATED APPLICATION

The present application claims priority from Japanese Patent Application No. 2017-129493, which was filed on Jun. 30, 2017, the disclosure of which is herein incorporated by reference in its entirety.

BACKGROUND

The following disclosure relates to a label medium and a cassette for creating a label to be wrapped and held on a wrapped member such as a cable.

There is known a label printed on a printed tape having an adhesive layer. The label has a label main portion and a wrapping portion. Information is printed on the label main portion based on print data. Mountain fold is performed for the label main portion along perforation, so that back surfaces of the label main portion are stuck to each other by the adhesive layer. The wrapping portion is folded back and wrapped on a wrapped member such as a cable. Back surfaces of the wrapping portion are thereby bonded to the wrapped member by the adhesive layer, and at the same time the back surfaces of the wrapping portion are bonded to each other by the adhesive layer.

SUMMARY

The above-described label is bonded to the wrapped member by the adhesive layer. This leads to difficulty in removing the label from the wrapped member and in changing a position at which the label is held on the wrapped member.

Accordingly, an aspect of the disclosure relates to a label medium and a cassette containing the label medium for creating a label easily changeable in position with respect to the wrapped member and easily removable from the wrapped member.

One aspect of the disclosure relates to a label medium, including: a mount sheet; and a label stuck to the mount sheet and including (i) a first indicator portion and a second indicator portion each including a region on which information is printable, (ii) a first wrapping portion and a second wrapping portion to be wrapped on a wrapped member, (iii) a first through portion including at least a portion of a first hole or a first slit through which the first indicator portion and the second indicator portion are passed, and (iv) a second through portion including at least a portion of a second hole or a second slit through which the first indicator portion and the second indicator portion are passed, wherein the first indicator portion and the second indicator portion are arranged in order of the first indicator portion and the second indicator portion in a first direction parallel with a surface of the mount sheet and opposed to a second direction, and the first indicator portion and the second indicator portion are connected to each other via a first line extending in a third direction orthogonal to the first direction, wherein the second indicator portion, the second wrapping portion, and the second through portion are connected to each other and arranged in order of the second indicator portion, the second wrapping portion, and the second through portion in the first direction, wherein the first wrapping portion and the first through portion are arranged in order of the first wrapping portion and the first through portion in one of the first direction and the second direction, wherein at least one pair of (a) a pair of the first wrapping portion and the second wrapping portion and (b) a pair of the first through portion and the second through portion are connected to each other via a second line, wherein at least a portion of the first indicator portion and at least a portion of the second indicator portion are symmetric with respect to a first imaginary line extending along the first line, wherein at least a portion of the first wrapping portion and at least a portion of the second wrapping portion are symmetric with respect to a second imaginary line extending along the second line, wherein at least a portion of the first through portion and at least a portion of the second through portion are symmetric with respect to the second imaginary line, and wherein at least a portion of the first hole or the first slit and at least a portion of the second hole or the second slit are symmetric with respect to the second imaginary line.

Another aspect of the disclosure relates to a cassette containing a roll that is formed by winding a label medium around a spool, wherein the label medium includes: a mount sheet; and a label stuck to the mount sheet and including (i) a first indicator portion and a second indicator portion each including a region on which information is printable, (ii) a first wrapping portion and a second wrapping portion to be wrapped on a wrapped member, (iii) a first through portion including at least a portion of a first hole or a first slit through which the first indicator portion and the second indicator portion are passed, and (iv) a second through portion including at least a portion of a second hole or a second slit through which the first indicator portion and the second indicator portion are passed, wherein the first indicator portion and the second indicator portion are arranged in order of the first indicator portion and the second indicator portion in a first direction parallel with a surface of the mount sheet and opposed to a second direction, and the first indicator portion and the second indicator portion are connected to each other via a first line extending in a third direction orthogonal to the first direction, wherein the second indicator portion, the second wrapping portion, and the second through portion are connected to each other and arranged in order of the second indicator portion, the second wrapping portion, and the second through portion in the first direction, wherein the first wrapping portion and the first through portion are arranged in order of the first wrapping portion and the first through portion in one of the first direction and the second direction, wherein at least one pair of (a) a pair of the first wrapping portion and the second wrapping portion and (b) a pair of the first through portion and the second through portion are connected to each other via a second line, wherein at least a portion of the first indicator portion and at least a portion of the second indicator portion are symmetric with respect to a first imaginary line extending along the first line, wherein at least a portion of the first wrapping portion and at least a portion of the second wrapping portion are symmetric with respect to a second imaginary line extending along the second line, wherein at least a portion of the first through portion and at least a portion of the second through portion are symmetric with respect to the second imaginary line, wherein at least a portion of the first hole or the first slit and at least a portion of the second hole or the second slit are symmetric with respect to the second imaginary line, and wherein the first indicator portion, the second indicator portion, the second wrapping portion, and the second through portion are arranged in order of the first indicator portion, the second indicator portion, the second wrapping portion, and the second through portion in a direction directed from one of opposite ends of the label medium, which one is connected to the spool, toward the other of the opposite ends of the label medium.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Figure 1:
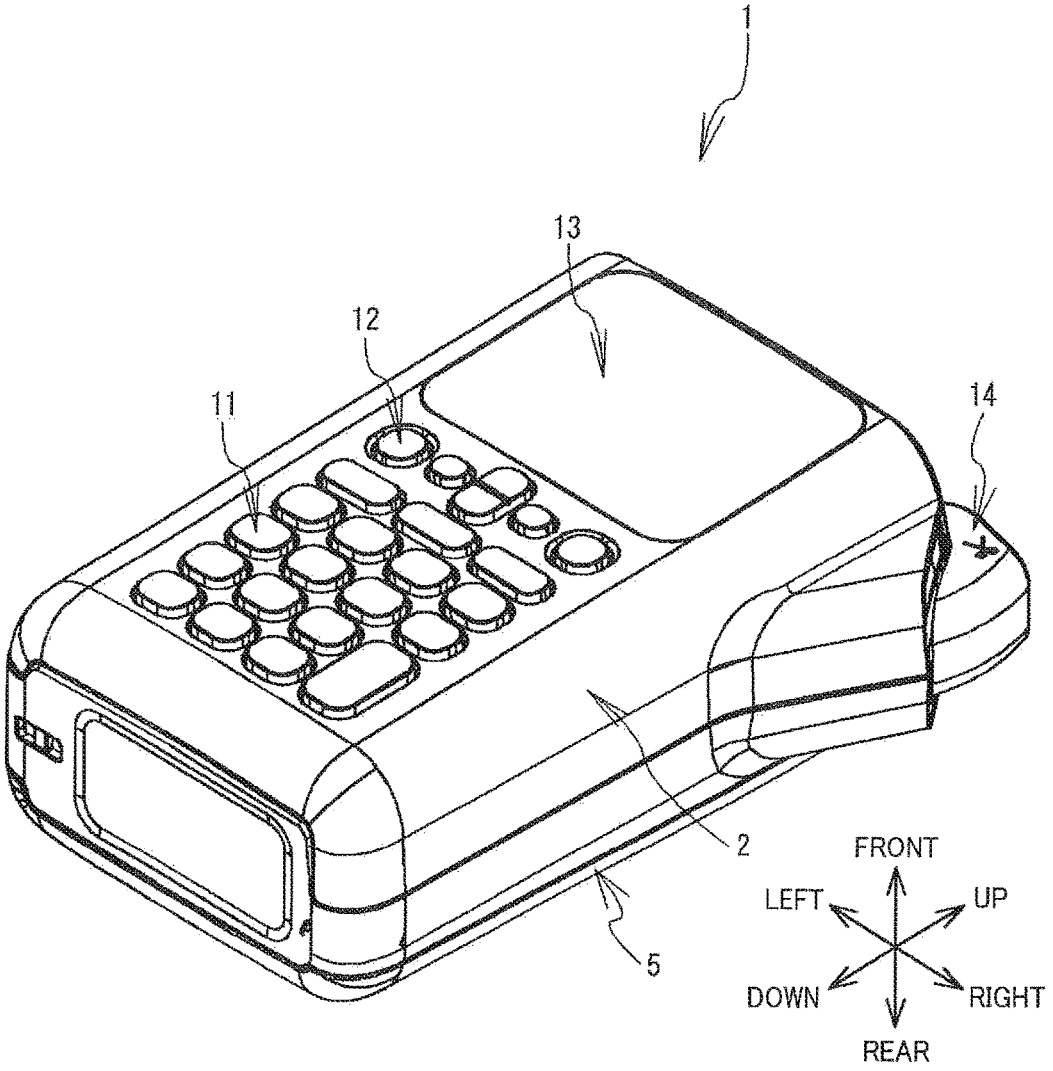
FIG. 1 is a perspective view of a printing apparatus viewed from a lower right rear side thereof.

Hereinafter, there will be described embodiments by reference to the drawings. The drawings are for explanation of technical features employable in the present disclosure. It is to be understood that the configuration illustrated in the drawings does not limit the present disclosure and is only one example.

Overall Configuration of Printing Apparatus

There will be described an overall configuration of a printing apparatus 1 with reference to FIGS. 1-3. The upper side, the lower side, the lower right side, the upper left side, the upper right side, and the lower left side in FIG. 1 are defined as a front side, a rear side, a right side, a left side, an upper side, and a lower side of the printing apparatus 1, respectively.

As illustrated in FIG. 1, the printing apparatus 1 has a substantially rectangular parallelepiped shape. The printing apparatus 1 includes a body housing 2 and a cover 5. The body housing 2 and the cover 5 are formed of resin. A keyboard 11 is provided on a lower portion of an upper surface of the body housing 2. The keyboard 11 is used for input of characters, for example. A function key group 12 is provided on an upper side of the keyboard 11. The function key group 12 is for turning a power source on and off and controlling print keys and the printing apparatus 1, for example. A liquid crystal display 13 is provided on an upper side of the function key group 12. The liquid crystal display 13 is configured to display characters and symbols input by a user, for example. The cover 5 is openably attached to a lower portion of the body housing 2.

Figure 2:
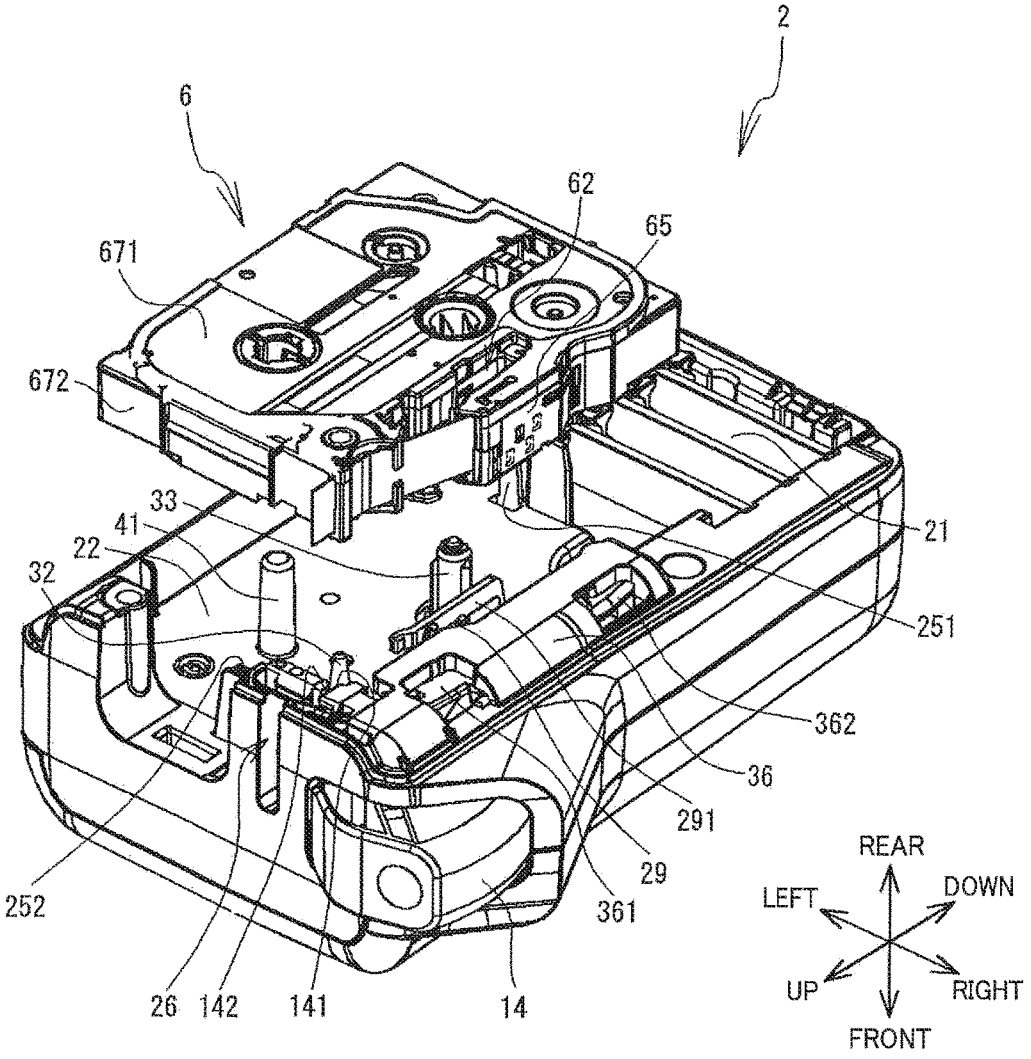
FIG. 2 is a perspective view of the printing apparatus, with a cover opened.
Figure 3:
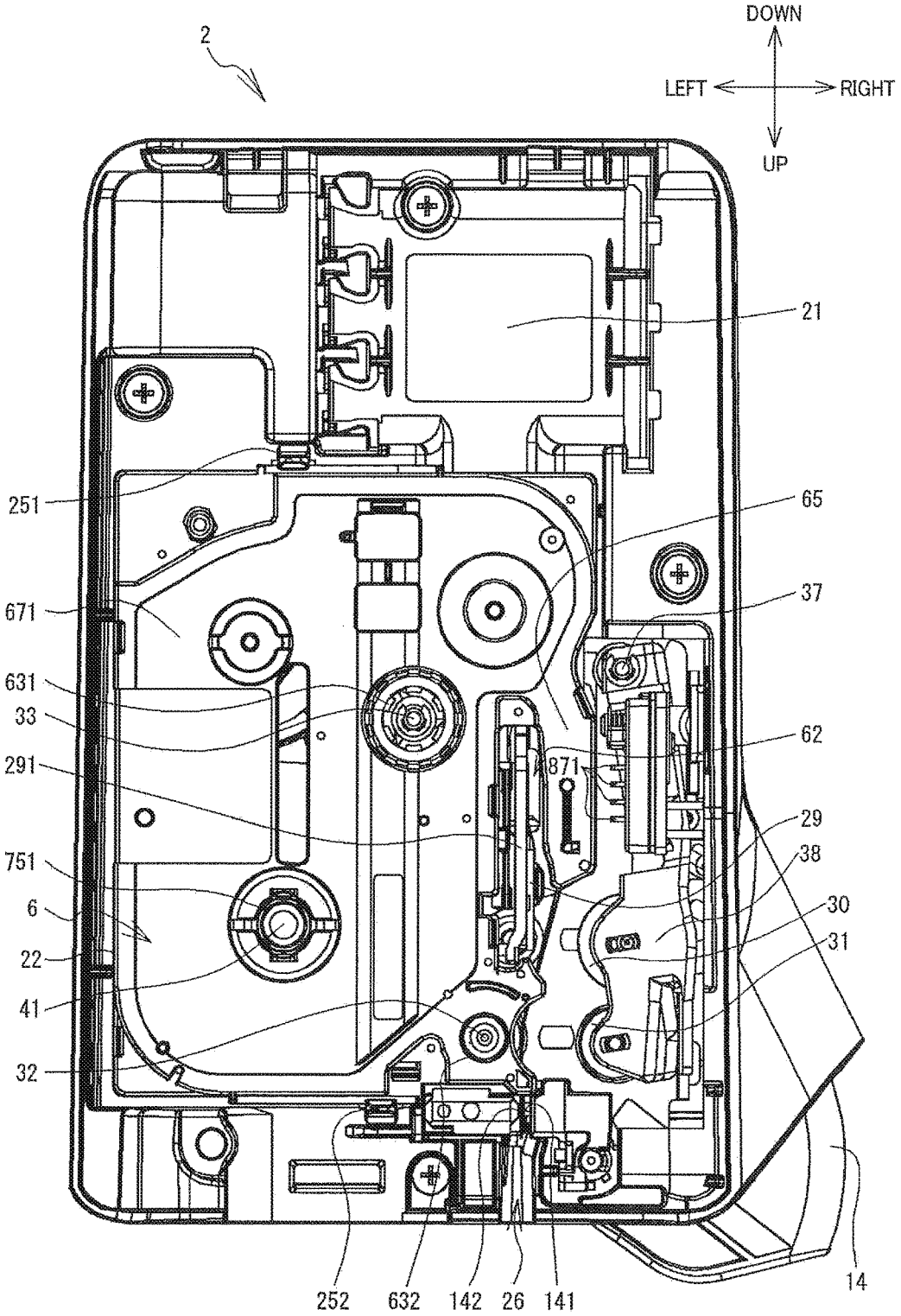
FIG. 3 is a plan view of a protector partly cut out.

As illustrated in FIGS. 2 and 3, a battery holder 21 is provided at a lower right corner portion of the body housing 2. Three batteries are installable in and removable from the battery holder 21. A cassette holder 22 is provided on an upper side of the battery holder 21 so as be contiguous to the battery holder 21. A tape cassette 6 is installable in and removable from the cassette holder 22 through its rear portion. A hook 251 protrudes rearward from a lower end portion of the cassette holder 22. A hook 252 protrudes rearward from an upper end portion of the cassette holder 22. The hooks 251, 252 are engageable with the tape cassette 6 installed on the cassette holder 22.

An upper portion of the body housing 2 has a label output opening 26. A cutting knob 14 is provided on a corner portion located to the right of the label output opening 26. A movable blade 141 is provided in the label output opening 26. When pushed inwardly, the cutting knob 14 moves the movable blade 141 toward a fixed blade 142 to cut the printed label medium 60 (see FIG. 4). The printed label medium 60 cut by the fixed blade 142 and the movable blade 141 is discharged from the label output opening 26.

As illustrated in FIG. 3, the cassette holder 22 is provided with a thermal head 29, a platen roller 30, a tape sub-roller 31, a tape-driving-roller shaft 32, and a ribbon take-up shaft 33, for example. The platen roller 30 is provided to the right of the thermal head 29. The tape sub-roller 31 is provided near an upper portion of the platen roller 30. The tape-driving-roller shaft 32 is provided to the left of the tape sub-roller 31. The ribbon take-up shaft 33 is provided at a substantially center of the cassette holder 22.

The thermal head 29 is provided on a surface of a head holder 291 which faces rightward. The head holder 291 is provided on the cassette holder 22 so as to be substantially orthogonal to a direction in which the label medium 60 is conveyed in a head inserted portion 62 of the tape cassette 6.

The ribbon take-up shaft 33 is rotatably fitted in a ribbon take-up spool 631 provided on the tape cassette 6. The tape-driving-roller shaft 32 is rotatably fitted in a tape conveying roller 632 provided on the tape cassette 6. The ribbon take-up shaft 33 and the tape-driving-roller shaft 32 are rotated such that the label medium 60 and an ink ribbon 613 (see FIG. 4) are conveyed at the same speed.

As illustrated in FIG. 2, a protector 36 is provided at a right end portion of the body housing 2 which is located on an upper side of substantially the center of the body housing 2 in the up and down direction. The protector 36 is open toward the left side. The protector 36 has two through holes, namely, a cam guide hole 361 and a cam guide hole 362. In front of the protector 36, a platen holder 38 illustrated in FIG. 3 is supported so as to be pivotable about a pivot shaft 37. The platen roller 30 and the tape sub-roller 31 are supported by the platen holder 38 so as to be rotatable in the counterclockwise direction in plan view. A spring, not illustrated, urges the platen holder 38 such that the platen holder 38 pivots rightward about the pivot shaft 37.

Overall Configuration of Tape Cassette 6

Figure 4:
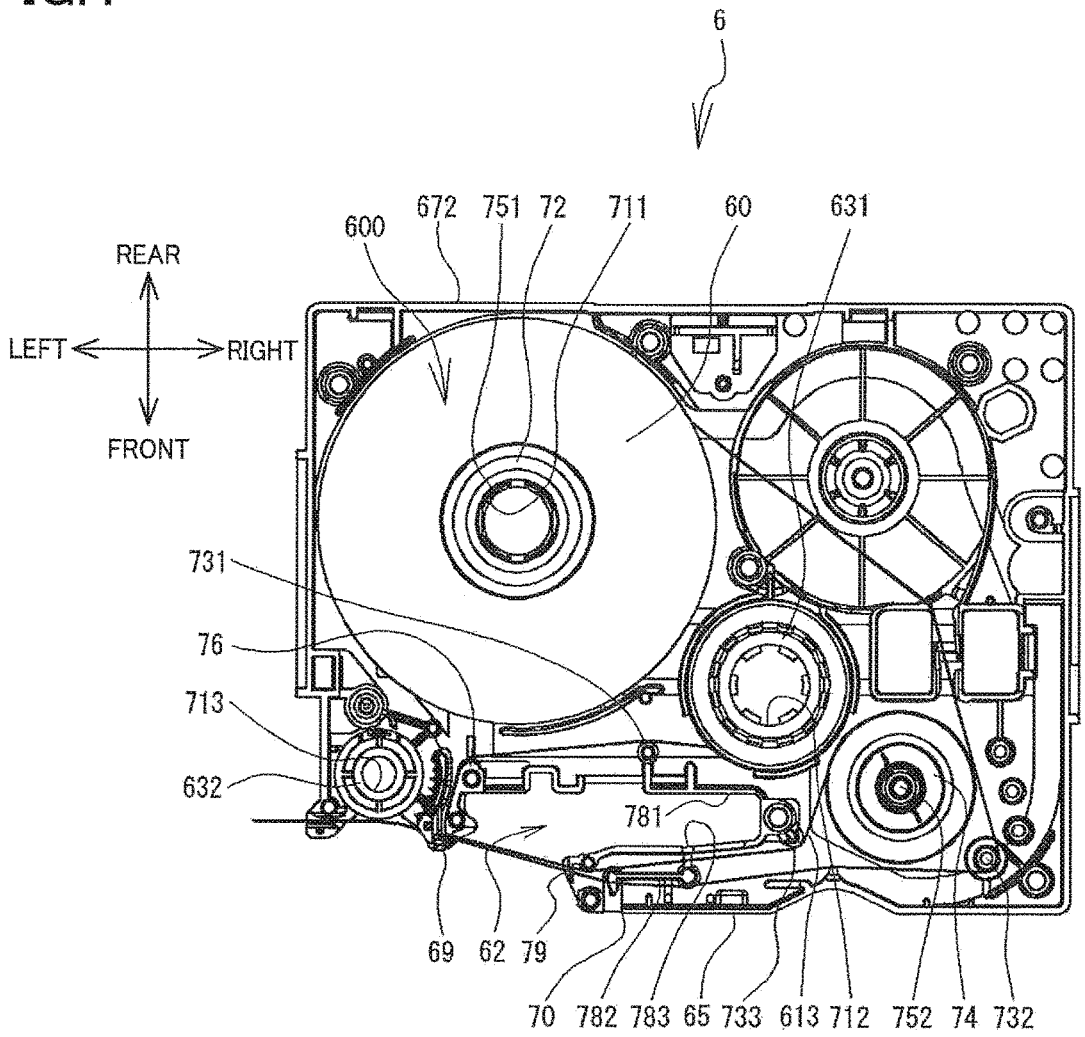
FIG. 4 is a plan view of a tape cassette, with an upper casing removed.

There will be next explained an overall configuration of the tape cassette 6. In the following explanation, the lower side, the upper side, the right side, and the left side in FIG. 4, and the front surface and the back surface of the sheet of FIG. 4 are defined as a front side, a rear side, a right side, a left side, an upper side, and a lower side of the tape cassette 6, respectively.

As illustrated in FIG. 2, the tape cassette 6 is shaped like a box having a substantially rectangular shape in plan view. The tape cassette 6 includes an upper casing 671 and a lower casing 672. As illustrated in FIG. 4, the tape cassette 6 has a support hole 711, a support hole 712, and a support hole 713. The support hole 711 supports a tape spool 72 such that the tape spool 72 is pivotable. The label medium 60 is rolled around the tape spool 72. The tape spool 72 holds a roll 600 formed by rolling the label medium 60. The support hole 712 supports the ribbon take-up spool 631. The ribbon take-up spool 631 takes up the ink ribbon 613 from a ribbon spool 74. The tape spool 72 and the ribbon spool 74 are rotatably fitted on a cassette boss 751 and a reel boss 752, respectively. The cassette boss 751 and the reel boss 752 are provided upright on a lower surface of the lower casing 672. The support hole 713 supports the tape conveying roller 632 such that the tape conveying roller 632 is rotatable. The tape conveying roller 632 and the tape sub-roller 31 (see FIG. 3) draw the label medium 60 from the roll 600 disposed around the tape spool 72.

An arm 65 protruding in an arm shape is provided on a front surface portion of the tape cassette 6. The head inserted portion 62 is formed by the arm 65 and a side wall 781 opposed to the arm 65 such that the head inserted portion 62 has a substantially U-shape in plan view. The head holder 291 (see FIG. 3) is inserted in the head inserted portion 62.

A pair of upper and lower guides 69 are provided near a front portion of the tape conveying roller 632. A ribbon separator 76 is provided near rear portions of the respective guides 69. A separation wall 782 shaped like a thin plate is provided at a central area between a front wall 70 of the arm 65 and a back wall 783 of the arm 65 which is nearer to the head inserted portion 62 than the front wall 70. An arm opening 79 is formed near a left end portion of the separation wall 782.

Print Procedure

As illustrated in FIGS. 2, 3, and 4, the ribbon take-up shaft 33 and the tape-driving-roller shaft 32 are respectively fitted in the ribbon take-up spool 631 and the tape conveying roller 632 provided on the tape cassette 6, and the head holder 291 is inserted in the head inserted portion 62. A positioning boss 41 provided upright on a bottom surface portion of the cassette holder 22 is fitted in the cassette boss 751. As a result, the tape cassette 6 is pressed in a state in which the tape cassette 6 is positioned, whereby the tape cassette 6 is installed on the cassette holder 22. After the tape cassette 6 is installed on the cassette holder 22, the cover 5 is closed. In the case where the cover 5 is closed, a roller-holder cam, not illustrated, provided on the cover 5 is fitted in the cam guide hole 361. The roller-holder cam presses the platen holder 38 leftward. The platen holder 38 pivots leftward against an urging force of the spring, not illustrated.

The label medium 60 is conveyed from the tape spool 72 via a guide pin 732 through an area between the separation wall 782 and the front wall 70 of the arm 65. The ink ribbon 613 is conveyed from the ribbon spool 74 via a guide pin 733 through an area between the separation wall 782 and the back wall 783 of the arm 65. The ink ribbon 613 and the label medium 60 are arranged one on another and conveyed from the arm opening 79 to the head inserted portion 62. The label medium 60 and the ink ribbon 613 are then pressed onto the thermal head 29 by the platen roller 30. Heat generated by the thermal head 29 heats the ink ribbon 613 from an upper side thereof. As a result, ink is transferred to the label medium 60 by heat, so that information such as characters is printed on the label medium 60.

The ink ribbon 613 is separated from the label medium 60 by the ribbon separator 76. The separated ink ribbon 613 is conveyed through a guide pin 731 and taken up by the ribbon take-up spool 631. The printed label medium 60 from which the ink ribbon 613 is separated by the ribbon separator 76 is conveyed to the tape conveying roller 632 in a state in which upward and downward movement of the printed label medium 60 is restricted by the guides 69. A printed first label medium 60A is then pressed by the tape sub-roller 31 onto the tape conveying roller 632 that is rotated by the tape-driving-roller shaft 32. The printed label medium 60 is discharged from the label output opening 26 by rotation of the tape conveying roller 632.

First Label Medium 60A According to First Embodiment

Figure 5A:
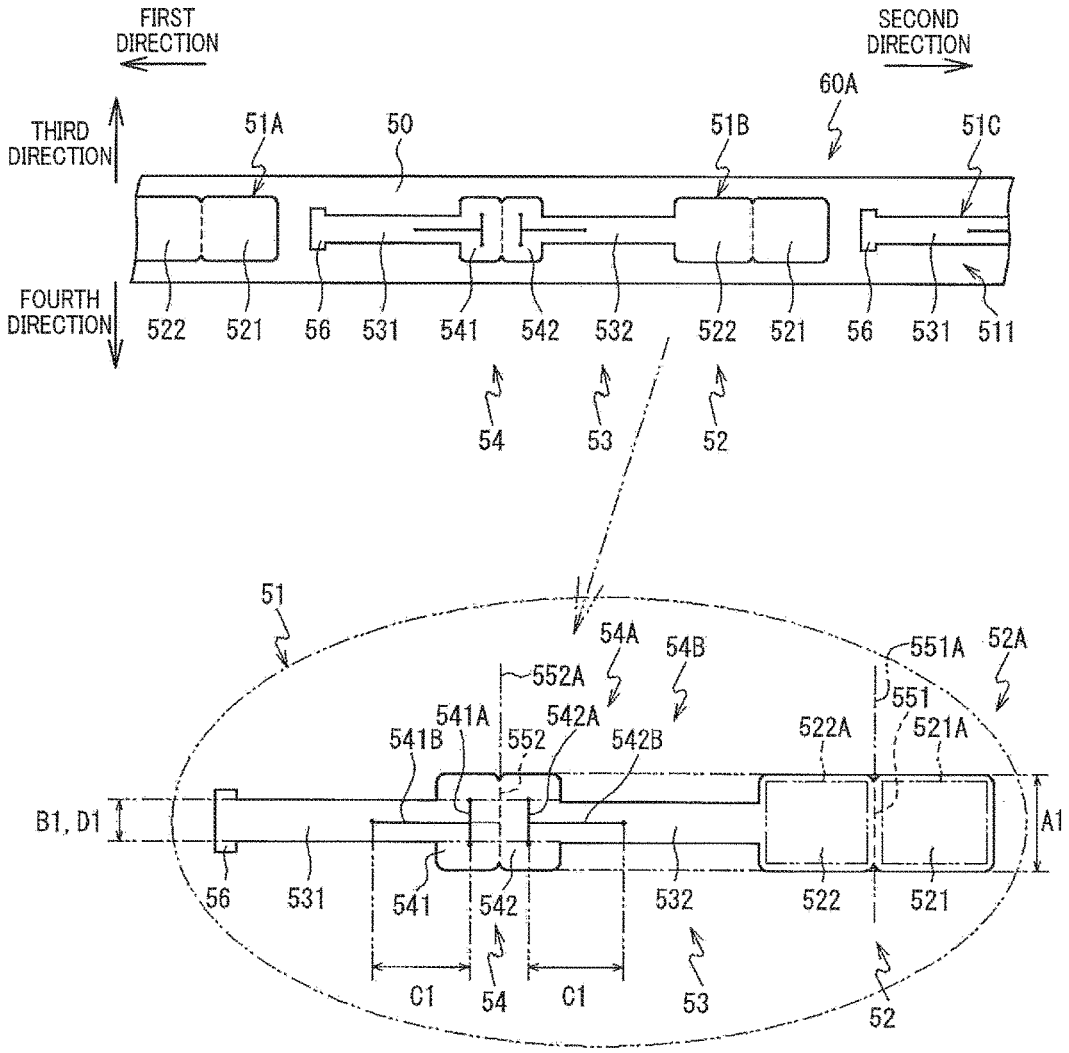
FIGS. 5A and 5B are views of a first label medium.
Figure 5B:
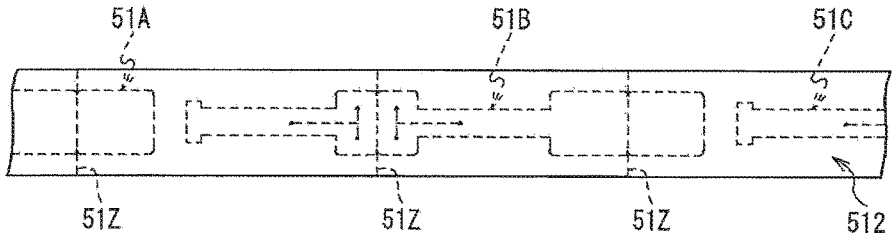

There will be next explained the first label medium 60A according to a first embodiment of the label medium 60 with reference to FIGS. 5A and 5B. The first label medium 60A includes an elongated substrate 511 (see FIG. 5A) and an elongated mount sheet 512 (see FIG. 5B). The substrate 511 and the mount sheet 512 have the same shape. The substrate 511 includes a frame portion 50 and labels 51A, 51B, 51C, and so on (which may be hereinafter collectively referred to as "label 51"). The labels 51A, 51B, 51C, and so on are arranged in an elongated (longitudinal) direction of the first label medium 60A. The ink is transferred from the ink ribbon 613 to the label 51. The mount sheet 512 is release paper which is separated in use of the label 51. The substrate 511 (the label 51 and the frame portion 50) and the mount sheet 512 are stacked on each other. Adhesive is applied to facing surfaces of the substrate 511 and the mount sheet 512. The adhesive is disposed between the substrate 511 and the mount sheet 512. The label 51 and the frame portion 50 are stuck to the mount sheet 512 by the adhesive. The right and left direction in FIGS. 5A and 5B is directed in parallel with the surfaces of the substrate 511 and the mount sheet 512 of the first label medium 60A and coincides with the elongated direction of the first label medium 60A. A right end portion of the first label medium 60A in FIG. 5A is connected to the tape spool 72. The first label medium 60A is conveyed through an area near the thermal head 29, then printed, and discharged through the label output opening 26 in order from a left end portion of the first label medium 60A in FIG. 5A.

One of opposite directions as the elongated direction of the first label medium 60A is a direction directed toward an end portion of the first label medium 60A which is opposite to its end portion connected to the tape spool 72. This direction may be hereinafter referred to as "first direction" coinciding with the left direction in FIGS. 5A and 5B. The other of the opposite directions as the elongated direction of the first label medium 60A is a direction directed toward the end portion of the first label medium 60A which is connected to the tape spool 72. This direction may be hereinafter referred to as "second direction" coinciding with the right direction in FIGS. 5A and 5B. The first direction and the second direction are parallel with the elongated direction of the first label medium 60A. A direction orthogonal to the elongated direction of the first label medium 60A is hereinafter referred to as "orthogonal direction". One of opposite directions as the orthogonal direction (the up direction in FIGS. 5A and 5B) may be hereinafter referred to as "third direction". The other of the opposite directions as the orthogonal direction (the down direction in FIGS. 5A and 5B) may be hereinafter referred to as "fourth direction". The third direction and the fourth direction are parallel with the orthogonal direction.

As illustrated in FIG. 5A, the label 51 includes a first indicator portion 521, a second indicator portion 522, a first wrapping portion 531, a second wrapping portion 532, a first through portion 541, a second through portion 542, and an overlapping portion 56. The first indicator portion 521 and the second indicator portion 522 have the same shape and the same size. The first wrapping portion 531 and the second wrapping portion 532 have the same shape and the same size. The first through portion 541 and the second through portion 542 have the same shape and the same size. The first indicator portion 521 and the second indicator portion 522 may be hereinafter collectively referred to as "indicator portion 52". The first wrapping portion 531 and the second wrapping portion 532 may be hereinafter collectively referred to as "wrapping portion 53". The first through portion 541 and the second through portion 542 may be hereinafter collectively referred to as "through portion 54".

The indicator portion 52 has a substantially square shape. The first indicator portion 521 and the second indicator portion 522 are arranged in the elongated direction of the first label medium 60A (i.e., the first direction and the second direction). More specifically, the first indicator portion 521 and the second indicator portion 522 are arranged in this order in the first direction. The first indicator portion 521 is located on a second-direction side of the second indicator portion 522. A first-direction-side end portion of the first indicator portion 521 and a second-direction-side end portion of the second indicator portion 522 are connected to each other at a first line 551. The first line 551 extends parallel with the orthogonal direction (i.e., the third direction and the fourth direction). That is, the first line 551 is a line which is a portion of the substrate 511 and in which perforation which will be described below is formed, and the first line 551 connects the first-direction-side end portion of the first indicator portion 521 and the second-direction-side end portion of the second indicator portion 522 to each other. The first line 551 has an elongated shape, and the elongated direction of the first line 551 is parallel with the widthwise direction of the first label medium 60A (i.e., the orthogonal direction) and parallel with the third direction. The first line 551 includes the perforation formed in the substrate 511, and the elongated direction of the first line 551 and the direction in which the perforation extends are parallel with each other. The perforation formed at the first line 551 is located between the first-direction-side end portion of the first indicator portion 521 and the second-direction-side end portion of the second indicator portion 522. The direction in which the perforation extends is parallel with the widthwise direction of the first label medium 60A (i.e., the orthogonal direction) and parallel with the third direction. The first indicator portion 521 and the second indicator portion 522 are symmetric with respect to a first imaginary line 551A extending along the first line 551 in the orthogonal direction. That is, the first imaginary line 551A is an imaginary line which extends through the first line 551 in the widthwise direction of the first label medium 60A. The first imaginary line 551A is an imaginary line which is located equidistant from the first indicator portion 521 and the second indicator portion 522 and which extends in the widthwise direction of the first label medium 60A. The length of the indicator portion 52 in the orthogonal direction (i.e., the third direction and the fourth direction) is a length A1. The first imaginary line 551A is an imaginary line which extends in the widthwise direction of the first label medium 60A (i.e., the orthogonal direction) through the perforation formed at the first line 551. It is noted that the first line 551 also serves as a boundary line between the first-direction-side end portion of the first indicator portion 521 and the second-direction-side end portion of the second indicator portion 522.

The indicator portion 52 has a region 52A on which information is printed with the ink transferred from the ink ribbon 613. The region 52A of the first indicator portion 521 will be referred to as "region 521A", and the region 52A of the second indicator portion 522 will be referred to as "region 522A".

The second wrapping portion 532 is connected to a first-direction-side end portion of the second indicator portion 522. The second wrapping portion 532 has a substantially rectangular shape. The longitudinal direction of the second wrapping portion 532 coincides with the elongated direction. The length of the second wrapping portion 532 in the orthogonal direction is less than the length A1 of the indicator portion 52 in the orthogonal direction. The second wrapping portion 532 extends in the first direction from a central portion of a first-direction-side end portion of the second indicator portion 522 in the orthogonal direction. The length of the second wrapping portion 532 in the orthogonal direction is a length B1.

The second through portion 542 is connected to a first-direction-side end portion of the second wrapping portion 532. The second through portion 542 has a substantially rectangular shape. The length of the second through portion 542 in the orthogonal direction is equal to the length A1 of the indicator portion 52 in the orthogonal direction and greater than the length B1 of the second wrapping portion 532 in the orthogonal direction. The first through portion 541 is located on a first-direction side of the second through portion 542. A second-direction-side end portion of the first through portion 541 and a first-direction-side end portion of the second through portion 542 are connected to each other at a second line 552. The second line 552 extends parallel with the orthogonal direction. That is, the second line 552 is a line which is a portion of the substrate 511 and in which perforation which will be described below is formed, and the second line 552 connects the second-direction-side end portion of the first through portion 541 and the first-direction-side end portion of the second through portion 542 to each other. The second line 552 has an elongated shape, and the elongated direction of the second line 552 is parallel with the widthwise direction of the first label medium 60A (i.e., the orthogonal direction) and parallel with the third direction. The second line 552 includes the perforation formed in the substrate 511, and the elongated direction of the second line 552 and the direction in which the perforation extends are parallel with each other. The perforation formed at the second line 552 is located between the second-direction-side end portion of the first through portion 541 and the first-direction-side end portion of the second through portion 542. The direction in which the perforation extends is parallel with the widthwise direction of the first label medium 60A (i.e., the orthogonal direction) and parallel with the third direction. The first through portion 541 and the second through portion 542 are symmetric with respect to a second imaginary line 552A extending along the second line 552 in the orthogonal direction. That is, the second imaginary line 552A is an imaginary line which extends through the second line 552 in the widthwise direction of the first label medium 60A. The second imaginary line 552A is an imaginary line which is located equidistant from the first through portion 541 and the second through portion 542 and which extends in the widthwise direction of the first label medium 60A. The second imaginary line 552A is an imaginary line which extends in the widthwise direction of the first label medium 60A (i.e., the orthogonal direction) through the perforation formed at the second line 552. It is noted that the second line 552 also serves as a boundary line between the second-direction-side end portion of the first through portion 541 and the first-direction-side end portion of the second through portion 542.

The first wrapping portion 531 is connected to a first-direction-side end portion of the first through portion 541. The first wrapping portion 531 has a substantially rectangular shape. The longitudinal direction of the first wrapping portion 531 coincides with the elongated direction. The length of the first wrapping portion 531 in the orthogonal direction is a length B1. The length of the first wrapping portion 531 in the orthogonal direction is less than the length A1 of each of the indicator portion 52 and the through portion 54 in the orthogonal direction. The first wrapping portion 531 extends in the first direction from a central portion of the first-direction-side end portion of the first through portion 541 in the orthogonal direction. The first wrapping portion 531 and the second wrapping portion 532 are symmetric with respect to the second imaginary line 552A.

The overlapping portion 56 is provided on a first-direction-side end portion of the first wrapping portion 531. The overlapping portion 56 has a substantially rectangular shape. The length of the overlapping portion 56 in the orthogonal direction is slightly greater than the length of the wrapping portion 53 in the orthogonal direction.

The first indicator portion 521, the second indicator portion 522, the second wrapping portion 532, the second through portion 542, the first through portion 541, the first wrapping portion 531, and the overlapping portion 56 are arranged in this order in the first direction. That is, the first indicator portion 521, the second indicator portion 522, the second wrapping portion 532, the second through portion 542, the first through portion 541, the first wrapping portion 531, and the overlapping portion 56 are arranged in this order in a direction directed toward an end portion of the first label medium 60A which is opposite to its end portion connected to the tape spool 72. The first wrapping portion 531 and the first through portion 541 are arranged in this order in the second direction. The first indicator portion 521, the second indicator portion 522, the second wrapping portion 532, the second through portion 542, the first through portion 541, the first wrapping portion 531, and the overlapping portion 56 overlap one another in the first direction at their respective regions including their respective centers in the orthogonal direction. That is, when viewed in the first direction, at least a portion of the first indicator portion 521, at least a portion of the second indicator portion 522, at least a portion of the second wrapping portion 532, at least a portion of the second through portion 542, at least a portion of the first through portion 541, and at least a portion of the first wrapping portion 531 overlap one another. When viewed in the first direction, at least a portion of the first indicator portion 521 and at least a portion of the first wrapping portion 531 overlap each other. When viewed in the first direction, at least a portion of the second indicator portion 522 and at least a portion of the second wrapping portion 532 overlap each other.

The first through portion 541 has a first slit 541A, and the second through portion 542 has a second slit 542A. Each of the first slit 541A and the second slit 542A extends in the orthogonal direction. The first slit 541A and the second slit 542A are symmetric with respect to the second imaginary line 552A. The length D1 of each of the first slit 541A and the second slit 542A in the orthogonal direction is equal to the length B1 of the wrapping portion 53 in the orthogonal direction. The first slit 541A and the second slit 542A may be hereinafter collectively referred to as "slit 54A". The slit 54A, the first wrapping portion 531, and the second wrapping portion 532 overlap one another in the first direction. That is, when viewed in the first direction, the first wrapping portion 531 and at least a portion of the first slit 541A overlap each other, and when viewed in the first direction, the second wrapping portion 532 and at least a portion of the second slit 542A overlap each other.

A first slit 541B is formed so as to extend over a portion of the first through portion 541 and a portion of the first wrapping portion 531. The first slit 541B extends in the first direction, from the center of the first slit 541A in the orthogonal direction, through the respective centers of the first through portion 541 and the first wrapping portion 531 in the orthogonal direction. A second slit 542B is formed so as to extend over a portion of the second through portion 542 and a portion of the second wrapping portion 532. The second slit 542B extends in the second direction, from the center of the second slit 542A in the orthogonal direction, through the respective centers of the second through portion 542 and the second wrapping portion 532 in the orthogonal direction. The first slit 541B and the second slit 542B are symmetric with respect to the second imaginary line 552A. The length C1 of each of the first slit 541B and the second slit 542B in the elongated direction is equal to the length A1 of the indicator portion 52 in the orthogonal direction. The first slit 541B and the second slit 542B may be hereinafter collectively referred to as "slit 54B". The slit 54B, the first wrapping portion 531, and the second wrapping portion 532 overlap one another in the first direction.

The frame portion 50 is the entire area of the substrate 511 except the labels 51. Slits are formed in the substrate 511 along boundaries between the frame portion 50 and each label 51. The user may detach the substrate 511 along the slits to peel off only the label 51 from the mount sheet 512. The frame portion 50 remains stuck to the mount sheet 512 in this operation.

As illustrated in FIG. 5B, the mount sheet 512 has perforations 51Z each extending straight in the elongated direction. The perforations 51Z respectively extend through positions on the mount sheet 512 which are respectively opposed to the first lines 551 of the labels 51A, 51B, 51C. That is, the perforation 51Z is formed in the mount sheet 512 so as to be opposed to the imaginary line 550 for each label 51.

There will be next explained a method of attaching the label 51 to a wrapped member K in the form of a cable with reference to FIGS. 5A-6D. The printing apparatus 1 prints information on the region 52A of the indicator portion 52 of the label 51 illustrated in FIG. 5A. FIGS. 5A-6D omit illustration of the printed information. The user bends the first label medium 60A along the perforation 51Z formed in the mount sheet 512 and unbends the first label medium 60A to its original shape. This operation creates a bending line on the first line 551 and the second line 552 on the substrate 511. The bending line makes it easy to bend the first label medium. As illustrated in FIG. 6A, the user peels off the label 51 from the mount sheet 512 of the first label medium 60A.

First, the user bends the label 51 along the second line 552 and sticks adhesive-applied surfaces of the respective wrapping portions 53 of the label 51 to each other and adhesive-applied surfaces of the respective through portions 54 of the label 51 to each other. Here, the first wrapping portion 531 and the second wrapping portion 532 are symmetric with respect to the second imaginary line 552A (see FIG. 5A) extending through the second line 552, and likewise the first through portion 541 and the second through portion 542 are symmetric with respect to the second imaginary line 552A. Thus, the first wrapping portion 531 and the second wrapping portion 532 are stuck to each other without misalignment, and the first through portion 541 and the second through portion 542 are stuck to each other without misalignment. Accordingly, the adhesive-applied surfaces of the wrapping portions 53 and the through portions 54 are not exposed. Also, the first slit 541A and the second slit 542A are symmetric with respect to the second imaginary line 552A, and the first slit 541B and the second slit 542B are symmetric with respect to the second imaginary line 552A.

Accordingly, the first through portion 541 and the second through portion 542 are stuck to each other without misalignment between the first slit 541A and the second slit 542A and without misalignment between the first slit 541B and the second slit 542B. The overlapping portion 56 is stuck to a portion of the second indicator portion 522 which is connected to the second wrapping portion 532.

Figures 6A, 6B, 6C, 6D:
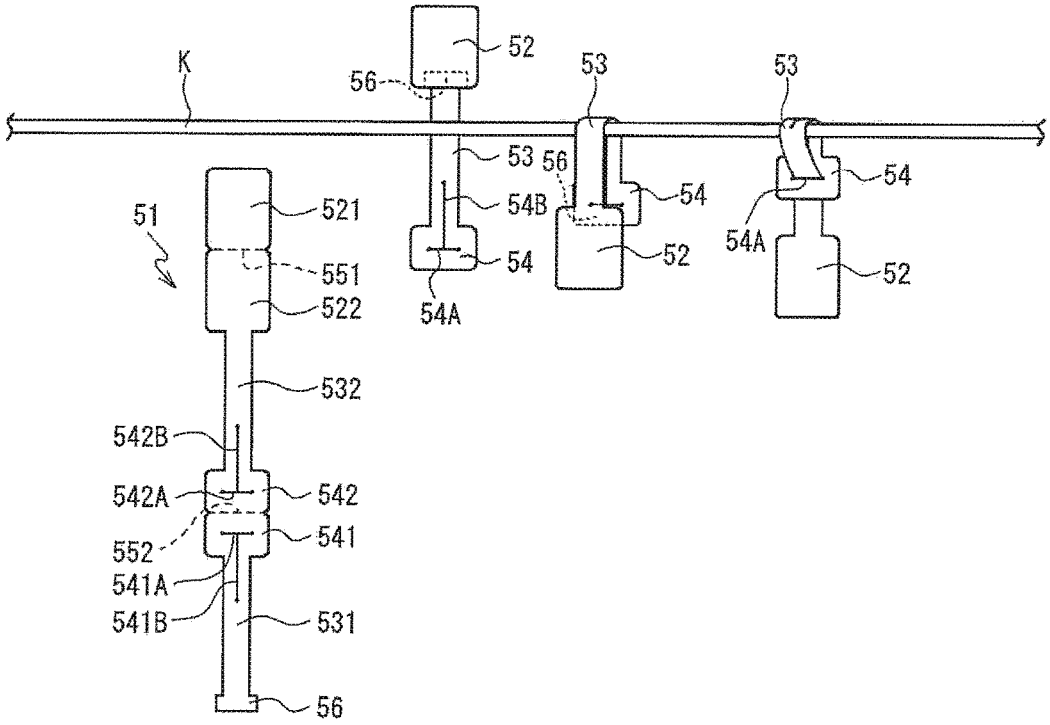
FIGS. 6A through 6D are views illustrating a method of attaching a label to a wrapped member.

The user then bends the label 51 along the first line 551. As illustrated in FIG. 6B, adhesive-applied surfaces of the indicator portions 52 of the label 51 are stuck to each other. Here, the first indicator portion 521 and the second indicator portion 522 are symmetric with respect to the first imaginary line 551A (see FIG. 5A) extending through the first line 551. Thus, the first indicator portion 521 and the second indicator portion 522 are stuck to each other without misalignment. Accordingly, the adhesive-applied surfaces of the indicator portion 52 are not exposed. Also, a portion of the first indicator portion 521 which is connected to the first wrapping portion 531 is stuck to the overlapping portion 56 stuck to the portion of the second indicator portion 522 which is connected to the second wrapping portion 532. That is, the overlapping portion 56 overlaps (i) the portion of the first indicator portion 521 which is connected to the first wrapping portion 531 and (ii) the portion of the second indicator portion 522 which is connected to the second wrapping portion 532 and is sandwiched between these portions.

The user then places the wrapping portion 53 on the wrapped member K. As illustrated in FIG. 6C, the user bends the wrapping portion 53 by twisting and passes the indicator portion 52 through the slit 54B of the through portion 54. As a result, the wrapping portion 53 is wrapped around the wrapped member K. As illustrated in FIG. 6D, the user then untwists the wrapping portion 53 and passes the wrapping portion 53 through the slit 54A of the through portion 54. The user then pulls the indicator portion 52 and the wrapping portion 53 to tighten the wrapping portion 53 on the wrapped member K. As a result, the attachment of the label 51 to the wrapped member K is complete. The label 51 is held on the wrapped member K in the state in which the wrapping portion 53 is wrapped around the wrapped member K.

It is noted that the user may loosen the wrapping portion 53 tightened on the wrapped member K to change a position at which the label 51 is held on the wrapped member K. The user may pull out the indicator portion 52 and the wrapping portion 53 from the slits 54A, 54B of the through portion 54 to remove the label 51 from the wrapped member K.

Effects in First Embodiment

In the first label medium 60A, the first indicator portion 521 and the second indicator portion 522 of the label 51 are symmetric with respect to the first imaginary line 551A extending through the first line 551. The first wrapping portion 531 and the second wrapping portion 532 are symmetric with respect to the second imaginary line 552A extending through the second line 552, the first through portion 541 and the second through portion 542 are symmetric with respect to the second imaginary line 552A, and the first slits 541A, 541B and the second slits 542A, 542B are symmetric with respect to the second imaginary line 552A. Thus, in the case where the label 51 is bent along the second line 552 for the first time after the label 51 is peeled off from the mount sheet 512, the first wrapping portion 531 and the second wrapping portion 532 are placed one on another, the first through portion 541 and the second through portion 542 are placed one on another, and the first slits 541A, 541B and the second slits 542A, 542B are aligned to each other. In the case where the label 51 is then bent along the first line 551, the first indicator portion 521 and the second indicator portion 522 are placed one on another. The user passes the indicator portion 52 through the slits 54A, 54B of the through portion 54 in this state and wraps the wrapping portion 53 on the wrapped member K in the form of a cable. As a result, the label 51 is held on the wrapped member K. In this case, the label 51 is not bonded to the wrapped member K with the adhesive, making it easy to move the label 51 on the wrapped member K and to remove the label 51 from the wrapped member K.

The first line 551 is located at the portion of the label 51 at which the first indicator portion 521 and the second indicator portion 522 are connected to each other. The second line 552 is located at the portion of the label 51 at which the first through portion 541 and the second through portion 542 are connected to each other. Thus, in the case where the label 51 is bent along the first line 551 and the second line 552, it is possible to reduce misalignment between the first indicator portion 521 and the second indicator portion 522 and misalignment between the first through portion 541 and the second through portion 542.

The second line 552 located at the portion of the label 51 at which the first through portion 541 and the second through portion 542 are connected to each other extends in the orthogonal direction. Thus, the first through portion 541 and the second through portion 542 are arranged in the elongated direction, with the second line 552 interposed therebetween. This configuration reduces the length of the label 51 in the orthogonal direction, resulting in reduction in required width of the first label medium 60A.

The first indicator portion 521, the second indicator portion 522, the first wrapping portion 531, the second wrapping portion 532, the first through portion 541, and the second through portion 542 overlap one another in the first direction at their respective regions including their respective centers in the orthogonal direction. This configuration reduces the length of the label 51 in the orthogonal direction, resulting in reduction in the required width of the first label medium 60A.

In the label 51, the overlapping portion 56 is provided on the first wrapping portion 531. In the case where the label 51 is bent along the second line 552, the overlapping portion 56 is placed on the second indicator portion 522. In the case where the label 51 is then bent along the first line 551, the first indicator portion 521 is placed so as to overlap the overlapping portion 56. The overlapping portion 56 is placed on the portion of the indicator portion 52 which is connected to the wrapping portion 53. With this configuration, the overlapping portion 56 improves the strength of the portion of the label 51 at which the indicator portion 52 and the wrapping portion 53 are connected to each other.

The length C1 of the slit 54B of the through portion 54 in the elongated direction is equal to the length A1 of the indicator portion 52 in the orthogonal direction. This configuration enables the user to pass the indicator portion 52 through the slit 54B in a state in which the indicator portion 52 is stretched in the process in which the user attaches the label 51 to the wrapped member K. Accordingly, the user can easily pass the indicator portion 52 through the slit 54B, whereby the user can easily attach the label 51 to the wrapped member K. In the case where the strength of the through portion 54 is taken into consideration, the length of the slit 54B is preferably small. Since the length C1 of the slit 54B of the through portion 54 is equal to the length A1 of the indicator portion 52 in the present embodiment, it is possible to pass the indicator portion 52 through the slit 54B in the state in which the indicator portion 52 is stretched and to reduce the size of the slit 54B. Accordingly, the strength of the through portion 54 is kept in the first label medium 60A.

The length D1 of the slit 54A of the through portion 54 in the orthogonal direction is equal to the length B1 of the wrapping portion 53 in the orthogonal direction. This configuration enables the user to pass the wrapping portion 53 through the slit 54A in a state in which the wrapping portion 53 is stretched in the process in which the user attaches the label 51 to the wrapped member K. Accordingly, the user can easily pass the wrapping portion 53 through the slit 54A, whereby the user can easily attach the label 51 to the wrapped member K. It is also possible to reduce bending of the wrapping portion 53 in the state in which the label 51 is held on the wrapped member K. Thus, the user can firmly hold the label 51 on the wrapped member K. In the case where the strength of the through portion 54 is taken into consideration, the length of the slit 54A is preferably small. Since the length C1 of the slit 54A of the through portion 54 is equal to the length B1 of the wrapping portion 53 in the present embodiment, it is possible to attach the wrapping portion 53 to the wrapped member K in the state in which the wrapping portion 53 is stretched and to reduce the size of the slit 54A. Accordingly, the strength of the through portion 54 is kept in the first label medium 60A.

The length B1 of the wrapping portion 53 in the orthogonal direction is less than the length A1 of each of the indicator portion 52 and the through portion 54 in the orthogonal direction. With this configuration, the length of the indicator portion 52 in the orthogonal direction is relatively large, resulting in large area of the region 52A on which the information is printable by the printing apparatus 1. Also, the length of the through portion 54 in the orthogonal direction is relatively large, whereby the strength of the through portion 54 is kept in the state in which the slits 54A, 54B are formed.

The adhesive is applied between the mount sheet 512 and the substrate 511 including the labels 51 and the frame portion 50. With this configuration, the user peels off the label 51 from the mount sheet 512 and bends the label 51 along the first line 551 and the second line 552, whereby the first indicator portion 521 and the second indicator portion 522 are stuck to each other with the adhesive, the first wrapping portion 531 and the second wrapping portion 532 are stuck to each other with the adhesive, and the first through portion 541 and the second through portion 542 are stuck to each other with the adhesive.

Each of the substrate 511 and the mount sheet 512 has an elongated shape. The labels 51A, 51B, 51C, and so on are arranged on the mount sheet 512 in the elongated direction. In the label 51, the indicator portion 52, the wrapping portion 53, and the through portion 54 are arranged in the elongated direction. With this configuration, the labels 51A, 51B, 51C, and so on are effectively arranged on the mount sheet 512 when compared with a case where the labels 51A, 51B, 51C, and so on are arranged in the orthogonal direction.

Each of the first line 551 and the second line 552 is the perforation formed in the substrate 511. This configuration enables the user to easily bend the label 51 along the first line 551 and the second line 552.

In the label 51, the first indicator portion 521 and the second indicator portion 522 have the same shape and the same size. The first wrapping portion 531 and the second wrapping portion 532 have the same shape and the same size. The first through portion 541 and the second through portion 542 have the same shape and the same size. Accordingly, when the label 51 is bent by the user along the first line 551 and the second line 552, the first indicator portion 521 and the second indicator portion 522 are arranged one on another without misalignment, the first wrapping portion 531 and the second wrapping portion 532 are arranged one on another without misalignment, and the first through portion 541 and the second through portion 542 are arranged one on another without misalignment.

The first slits 541A, 541B and the first wrapping portion 531 are arranged in the elongated direction. Likewise, the second slits 542A, 542B and the second wrapping portion 532 are arranged in the elongated direction. Thus, the first slits 541A, 541B and the first wrapping portion 531 overlap one another in the first direction, and the second slits 542A, 542B and the second wrapping portion 532 overlap one another in the first direction. This configuration enables the user to pass the wrapping portion 53 through the slit 54B of the through portion 54 by bending the wrapping portion 53 in the elongated direction in the process in which the user attaches the label 51 to the wrapped member K. Since the direction in which the wrapping portion 53 is bent and the direction in which the wrapped member K extends are orthogonal to each other, it is possible to increase the area of contact of the wrapping portion 53 with the wrapped member K, enabling the user to attach the label 51 to the wrapped member K stably.

In some case, the printing apparatus 1 is unable to perform printing at the start of the printing on a portion of the first label medium 60A which is located downstream of the position near the thermal head 29, i.e., a portion of the first label medium 60A which is located between the position near the thermal head 29 and a position near the label output opening 26. This is because the above-described portion of the first label medium 60A has already passed through the position near the thermal head 29 and is located downstream of the position near the thermal head 29. This case is not preferable because the printing apparatus 1 cannot efficiently use the first label medium 60A.

In the present embodiment, the first indicator portion 521, the second indicator portion 522, the second wrapping portion 532, the second through portion 542, the first through portion 541, and the first wrapping portion 531 of the label 51 of the first label medium 60A are arranged in this order in the first direction. That is, in the process in which the first label medium 60A is conveyed in printing, the indicator portion 52 of the label 51 passes through the position near the thermal head 29 after the through portion 54 and the wrapping portion 53 of the label 51 pass through the position near the thermal head 29. This configuration reduces a possibility that a portion of the first label medium 60A which is located downstream of the position near the thermal head 29 includes the indicator portion 52 at the start of printing. Accordingly, the printing apparatus 1 can efficiently use the first label medium 60A to print information on the region 52A of the indicator portion 52.

Second Label Medium 60B According to Second Embodiment

Figure 7A:
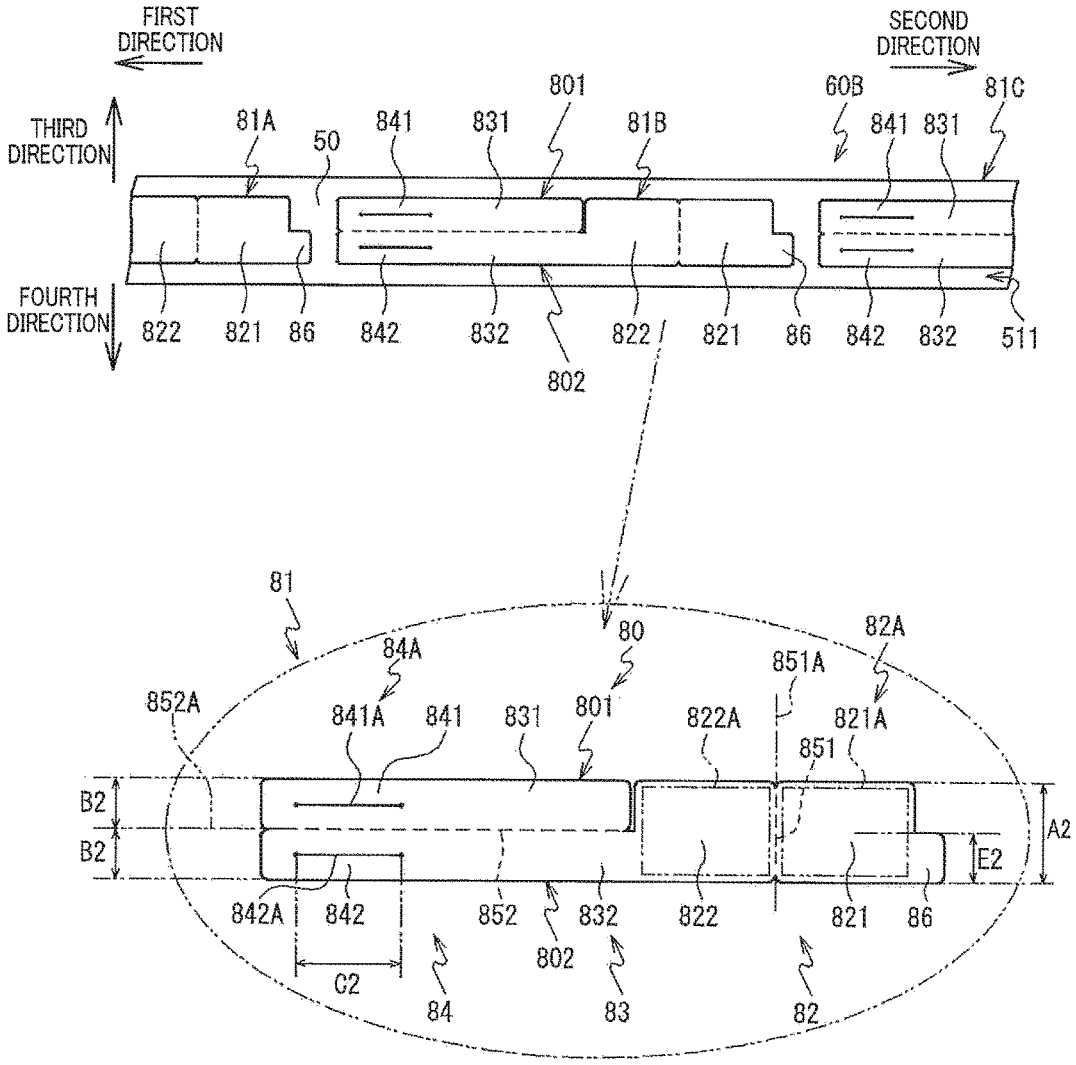
FIGS. 7A and 7B are views of a second label medium.
Figure 7B:
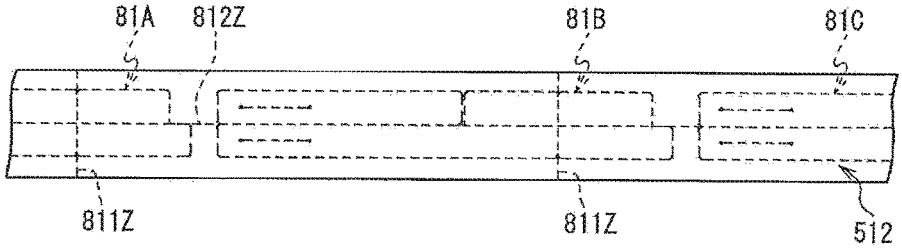

There will be next explained a second label medium 60B according to a second embodiment of the label medium 60 with reference to FIGS. 7A and 7B. It is noted that the same reference numerals as used in the first embodiment are used to designate the corresponding elements of the second embodiment, and an explanation of which is dispensed with. The substrate 511 includes the frame portion 50 and labels 81A, 81B, 81C, and so on (which may be hereinafter collectively referred to as "label 81"). The labels 81A, 81B, 81C, and so on are arranged in the elongated direction of the second label medium 60B.

As illustrated in FIG. 7A, the label 81 includes a first indicator portion 821, a second indicator portion 822, a first extended portion 801 (a first wrapping portion 831 and a first through portion 841), a second extended portion 802 (a second wrapping portion 832 and a second through portion 842), and an overlapping portion 86. The first indicator portion 821 and the second indicator portion 822 (which may be hereinafter collectively referred to as "indicator portion 82") have the same shape and the same size. Also, the first indicator portion 821 and the second indicator portion 822, and the first indicator portion 521 and the second indicator portion 522 of the label 51 have the same shape and the same size. The first extended portion 801 and the second extended portion 802 (which may be hereinafter collectively referred to as "extended portion 80") have the same shape and the same size. The first wrapping portion 831 and the second wrapping portion 832 (which may be hereinafter collectively referred to as "wrapping portion 83") have the same shape and the same size. The first through portion 841 and the second through portion 842 (which may be hereinafter collectively referred to as "through portion 84") have the same shape and the same size.

The first indicator portion 821 and the second indicator portion 822 are arranged in this order in the first direction. The first indicator portion 821 is located on a second-direction side of the second indicator portion 822. A first-direction-side end portion of the first indicator portion 821 and a second-direction-side end portion of the second indicator portion 822 are connected to each other at a first line 851 extending in the orthogonal direction. The first line 851 extends parallel with the orthogonal direction (i.e., the third direction and the fourth direction). That is, the first line 851 is a line which is a portion of the substrate 511 and in which perforation which will be described below is formed, and the first line 851 connects the first-direction-side end portion of the first indicator portion 821 and the second-direction-side end portion of the second indicator portion 822 to each other. The first line 851 has an elongated shape, and the elongated direction of the first line 851 is parallel with the widthwise direction of the second label medium 60B (i.e., the orthogonal direction) and parallel with the third direction. The first line 851 includes the perforation formed in the substrate 511, and the elongated direction of the first line 851 and the direction in which the perforation extends are parallel with each other. The perforation formed at the first line 851 is located between the first-direction-side end portion of the first indicator portion 821 and the second-direction-side end portion of the second indicator portion 822. The direction in which the perforation extends is parallel with the widthwise direction of the second label medium 60B (i.e., the orthogonal direction) and parallel with the third direction. The first indicator portion 821 and the second indicator portion 822 are symmetric with respect to a first imaginary line 851A extending along the first line 851 in the orthogonal direction. That is, the first imaginary line 851A is an imaginary line which extends through the first line 851 in the widthwise direction of the second label medium 60B and which is located equidistant from the first indicator portion 821 and the second indicator portion 822. The length of the indicator portion 82 in the orthogonal direction is a length A2. Also, the first imaginary line 851A extends in the widthwise direction of the second label medium 60B (i.e., the orthogonal direction) through the perforation formed at the first line 851. It is noted that the first line 851 also serves as a boundary line between the first-direction-side end portion of the first indicator portion 821 and the second-direction-side end portion of the second indicator portion 822. Information is printed on a region 821A of the first indicator portion 821 and a region 822A of the second indicator portion 822 with the ink transferred from the ink ribbon 613. The region 821A of the first indicator portion 821 and the region 822A of the second indicator portion 822 may be hereinafter collectively referred to as "region 82A".

The overlapping portion 86 is located on a second-direction side of the first indicator portion 821. The overlapping portion 86 has a substantially rectangular shape. A second-direction-side end portion of the first indicator portion 821 has a portion located on a fourth-direction side of the center of the first indicator portion 821 in the orthogonal direction, and the overlapping portion 86 extends in the second direction from this portion. The length of the overlapping portion 86 in the orthogonal direction is a length E2. The length E2 is half the length A2 of the indicator portion 82 in the orthogonal direction.

The second extended portion 802 is connected to a first-direction-side end portion of the second indicator portion 822. The second extended portion 802 has a substantially rectangular shape. The longitudinal direction of the second extended portion 802 coincides with the elongated direction. The first-direction-side end portion of the second indicator portion 822 has a portion located on a fourth-direction side of the center of the second indicator portion 822 in the orthogonal direction, and the second extended portion 802 extends in the first direction from this portion. A portion of the second extended portion 802 which is located on a second-direction side of the center of the second extended portion 802 in the elongated direction corresponds to the second wrapping portion 832. A portion of the second extended portion 802 which is located on a first-direction side of the center of the second extended portion 802 in the elongated direction corresponds to the second through portion 842. Thus, the second wrapping portion 832 is connected to the first-direction-side end portion of the second indicator portion 822, and the second through portion 842 is connected to the first-direction-side end portion of the second wrapping portion 832. The length of the second extended portion 802 in the orthogonal direction is a length B2. The length of each of the second wrapping portion 832 and the second through portion 842 in the orthogonal direction is the length B2. The length B2 is half the length A1 of the indicator portion 82 in the orthogonal direction and equal to the length E2 of the overlapping portion 86 in the orthogonal direction.

The first extended portion 801 is located on a third-direction side of the second extended portion 802 and located on a first-direction side of the second indicator portion 822. The length of the first extended portion 801 in the orthogonal direction is the length B2. Third-direction-side end portions of the first extended portion 801, the first indicator portion 821, and the second indicator portion 822 are the same in position in the orthogonal direction. A portion of the first extended portion 801 which is located on a third-direction side of the second wrapping portion 832 of the second extended portion 802 corresponds to the first wrapping portion 831. A portion of the first extended portion 801 which is located on a third-direction side of the second through portion 842 of the second extended portion 802 corresponds to the first through portion 841.

A fourth-direction-side end portion of the first extended portion 801 and a third-direction-side end portion of the second extended portion 802 are connected to each other at a second line 852. The second line 852 extends parallel with the elongated direction. The second line 852 is formed of perforation formed in the substrate 511. In other words, a fourth-direction-side end portion of the first through portion 841 and a third-direction-side end portion of the second through portion 842 are connected to each other at the second line 852. A fourth-direction-side end portion of the first wrapping portion 831 and a third-direction-side end portion of the second wrapping portion 832 are connected to each other at the second line 852. That is, the second line 852 is a line which is a portion of the substrate 511 and in which perforation is formed, and the second line 852 connects the fourth-direction-side end portion of the first through portion 841 and the third-direction-side end portion of the second through portion 842 to each other and connects the fourth-direction-side end portion of the first wrapping portion 831 and the third-direction-side end portion of the second wrapping portion 832 to each other. The second line 852 has an elongated shape, and the elongated direction of the second line 852 is parallel with the elongated direction of the second label medium 60B and parallel with the first direction. Also, the second line 852 includes the perforation formed in the substrate 511, and the elongated direction of the second line 852 and the direction in which the perforation extends are parallel with each other. The perforation formed at the second line 852 is located between the fourth-direction-side end portion of the first through portion 841 and the third-direction-side end portion of the second through portion 842 and between the fourth-direction-side end portion of the first wrapping portion 831 and the third-direction-side end portion of the second wrapping portion 832, and the direction in which the perforation extends is parallel with the elongated direction of the second label medium 60B and parallel with the first direction. A second-direction-side end portion of the first extended portion 801 and the first-direction-side end portion of the second indicator portion 822 are not connected to each other. That is, a second-direction-side end portion of the first wrapping portion 831 and the first-direction-side end portion of the second indicator portion 822 are not connected to each other.

The first extended portion 801 and the second extended portion 802 are symmetric with respect to a second imaginary line 852A extending in the orthogonal direction along the second line 852. More specifically, the first through portion 841 and the second through portion 842 are symmetric with respect to the second imaginary line 852A, and the first wrapping portion 831 and the second wrapping portion 832 are symmetric with respect to the second imaginary line 852A. That is, the second imaginary line 852A is an imaginary line which extends through the second line 852 in the elongated direction of the second label medium 60B and which is located equidistant from the first through portion 841 and the second through portion 842, and the second imaginary line 852A is located equidistant from the first wrapping portion 831 and the second wrapping portion 832 and extends in the elongated direction of the second label medium 60B. The second imaginary line 852A is an imaginary line which extends in the elongated direction of the second label medium 60B through the perforation formed at the second line 852. It is noted that the second line 852 also serves as a boundary line between the fourth-direction-side end portion of the first through portion 841 and the third-direction-side end portion of the second through portion 842 and also serves as a boundary line between the fourth-direction-side end portion of the first wrapping portion 831 and the third-direction-side end portion of the second wrapping portion 832.

The first indicator portion 821, the second indicator portion 822, the second wrapping portion 832, and the second through portion 842 are arranged in this order in the first direction. The first indicator portion 821, the second indicator portion 822, the first wrapping portion 831, and the first through portion 841 are arranged in this order in the first direction. That is, the first indicator portion 821, the second indicator portion 822, the second wrapping portion 832, and the second through portion 842 are arranged in this order in a direction directed toward an end portion of the second label medium 60B which is opposite to its end portion connected to the tape spool 72. The first indicator portion 821, the second indicator portion 822, the first wrapping portion 831, and the first through portion 841 are arranged in this order in the direction directed toward the end portion of the second label medium 60B which is opposite to its end portion connected to the tape spool 72. The first wrapping portion 831, the first through portion 841, and portions of the first indicator portion 821 and the second indicator portion 822 which are located on a third-direction side of the centers thereof in the orthogonal direction overlap each other in the first direction. The second wrapping portion 832, the second through portion 842, and portions of the first indicator portion 821 and the second indicator portion 822 which are located on a fourth-direction side of the centers thereof in the orthogonal direction overlap each other in the first direction.

The first through portion 841 has a first slit 841A. The second through portion 842 has a second slit 842A. The first slit 841A and the second slit 842A extend straight in the elongated direction. The first slit 841A and the second slit 842A are symmetric with respect to the second imaginary line 852A. The length C2 of each of the first slit 841A and the second slit 842A in the elongated direction is equal to the length A2 of the indicator portion 82 in the orthogonal direction. A portion of the first wrapping portion 831 and the first slit 841A overlap each other in the first direction, a portion of the second wrapping portion 832 and the second slit 842A overlap each other in the first direction. The first slit 841A and the second slit 842A may be hereinafter collectively referred to as "slit 84A".

As illustrated in FIG. 5B, the mount sheet 512 has perforations 811Z, 812Z. The perforations 811Z extend through positions on the mount sheet 512 which are respectively opposed to the first lines 851 of the respective labels 81A, 81B, 81C. That is, the perforations 811Z are formed in the mount sheet 512 so as to be opposed to the respective first imaginary lines 851A. The perforation 812Z extends through positions on the mount sheet 512 which are respectively opposed to the second lines 852 of the respective labels 81A, 81B, 81C. That is, the perforation 812Z is located on the mount sheet 512 so as to be opposed to the second imaginary lines 852A.

There will be next explained a method of attaching the label 81 to the wrapped member K in the form of a cable with reference to FIGS. 7A-8D. FIGS. 7A-8D omit illustration of printed information. The user bends the first label medium 60A along the perforations 811Z, 812Z formed in the mount sheet 512 and unbends the first label medium 60A to its original shape. This operation creates the bending line on the first line 851 and the second line 852 on the substrate 511. As illustrated in FIG. 8A, the user peels off the label 81 from the mount sheet 512 of the second label medium 60B.

First, the user bends the label 81 along the first line 851. Adhesive-applied surfaces of the indicator portions 82 of the label 81 are stuck to each other. Here, the first indicator portion 821 and the second indicator portion 822 are symmetric with respect to the first imaginary line 851A (see FIG. 7A) extending along the first line 851. Thus, the first indicator portion 821 and the second indicator portion 822 are stuck to each other without misalignment. Accordingly, the adhesive-applied surfaces of the indicator portion 82 are not exposed. The overlapping portion 86 is stuck to the second wrapping portion 832 at its portion near a position at which the second wrapping portion 832 and the second indicator portion 822 are connected to each other.

Figures 8A, 8B, 8C, 8D:
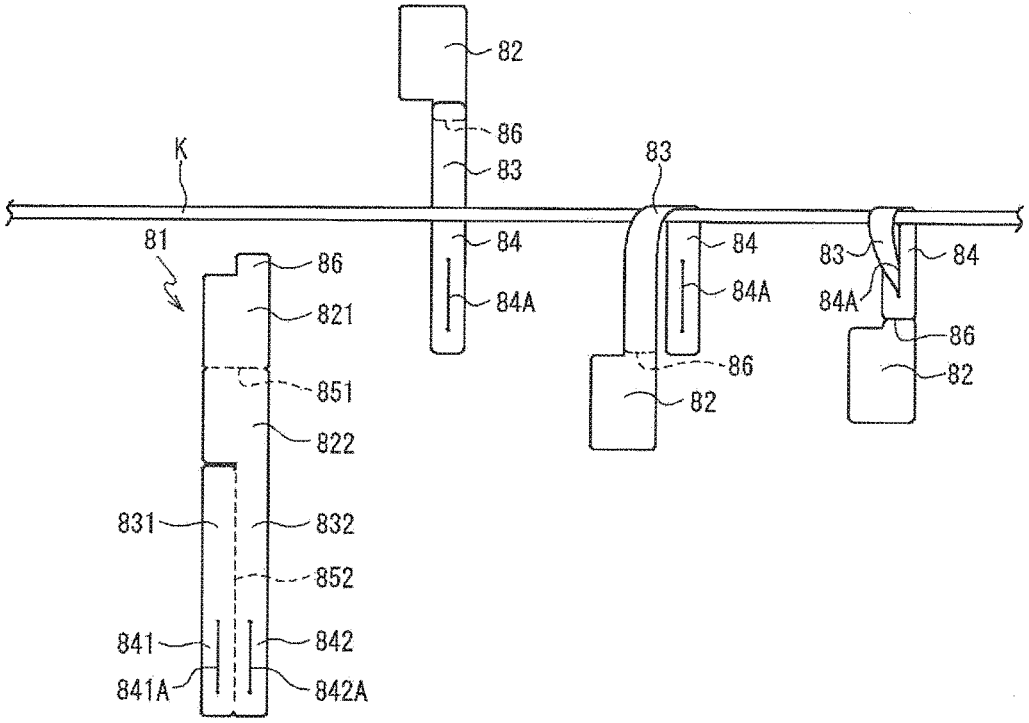
FIGS. 8A through 8D are views illustrating a method of attaching another label to the wrapped member.

The user bends the label 81 along the second line 852. As illustrated in FIG. 8B, the user sticks adhesive-applied surfaces of the respective wrapping portions 83 of the label 81 to each other and sticks adhesive-applied surfaces of the respective through portions 84 of the label 81 to each other. Here, the first wrapping portion 831 and the second wrapping portion 832 are symmetric with respect to the second imaginary line 852A (see FIG. 7A) extending through the second line 852, and the first through portion 841 and the second through portion 842 are symmetric with respect to the second imaginary line 852A. Accordingly, the first wrapping portion 831 and the second wrapping portion 832 are stuck to each other without misalignment, and the first through portion 841 and the second through portion 842 are stuck to each other without misalignment. Thus, the adhesive-applied surfaces of the wrapping portions 83 and the through portions 84 are not exposed. Also, the first slit 841A and the second slit 842A are symmetric with respect to the second imaginary line 852A. Accordingly, the first through portion 841 and the second through portion 842 are stuck to each other without misalignment between the first slit 841A and the second slit 842A. The first wrapping portion 831 is stuck to a portion of the second wrapping portion 832 to which the overlapping portion 86 is stuck. That is, the overlapping portion 86 overlaps a portion of the first wrapping portion 831 and a portion of the second wrapping portion 832.

As illustrated in FIG. 8C, the user then places the wrapping portion 83 on the wrapped member K and bends the wrapping portion 83. In this operation, the user bends the wrapping portion 83 by twisting and passes the indicator portion 82 through the slit 84A of the through portion 84. As a result, the wrapping portion 83 is wrapped around the wrapped member K. As illustrated in FIG. 8D, the user then pulls the indicator portion 82 and the wrapping portion 83 to tighten the wrapping portion 83 on the wrapped member K. As a result, the attachment of the label 81 to the wrapped member K is complete.

Effects in Second Embodiment

In the second label medium 60B, the second line 852 connects between the first wrapping portion 831 and the second wrapping portion 832 and connects between the first through portion 841 and the second through portion 842. The second line 852 extends in the elongated direction. That is, the direction in which the wrapping portion 83 and the through portion 84 extend and the direction in which the second line 852 extends are parallel with each other. With this configuration, when the label 81 is bent along the second line 852, it is possible to reduce misalignment between the first wrapping portion 831 and the second wrapping portion 832 and misalignment between the first through portion 841 and the second through portion 842.

The first wrapping portion 831, the first through portion 841, and the portions of the first indicator portion 821 and the second indicator portion 822 which are located on a third-direction side of the centers thereof in the orthogonal direction overlap each other in the first direction. The second wrapping portion 832, the second through portion 842, and the portions of the first indicator portion 821 and the second indicator portion 822 which are located on a fourth-direction side of the centers thereof in the orthogonal direction overlap each other in the first direction. This configuration reduces the length of the label 81 in the orthogonal direction, resulting in reduction in the width of the second label medium 60B.

The overlapping portion 86 is provided on a second-direction side of the first indicator portion 821 in the second direction. When the label 81 is bent along the first line 851 and the second line 852, the overlapping portion 86 overlaps the respective portions of the first wrapping portion 831 and the second wrapping portion 832. This configuration increases the strength of a portion of the label 81 at which the indicator portion 82 and the wrapping portion 83 are connected.

Modifications

While the embodiments have been described above, it is to be understood that the disclosure is not limited to the details of the illustrated embodiments, but may be embodied with various changes and modifications, which may occur to those skilled in the art, without departing from the spirit and scope of the disclosure. The following explanation is provided by taking the first label medium 60A (the label 51) in the first embodiment as an example, unless otherwise specified. However, similar modifications may be applied to the second label medium 60B (the label 81) according to the second embodiment.

For example, the wording "equal to" in the above-described description includes not only the wording "completely equal to" but also the wording "substantially equal to". Thus, the length A1 of the indicator portion 52 in the orthogonal direction and the length C1 of the slit 54A of the through portion 54 in the elongated direction only needs to be substantially equal to each other and may be different from each other strictly, for example. Likewise, the length B1 of the wrapping portion 53 in the orthogonal direction and the length D1 of the slit 54B of the through portion 54 in the orthogonal direction only needs to be substantially equal to each other and may be different from each other strictly. Likewise, the wording "symmetric with respect to the first imaginary line 551A (or the second imaginary line 552A)" includes not only the wording "strictly symmetric with respect to the first imaginary line 551A (or the second imaginary line 552A)" but also the wording "substantially symmetric with respect to the first imaginary line 551A (or the second imaginary line 552A)", for example. Thus, the shape of the first indicator portion 521 and the second indicator portion 522 may be slightly different from the symmetric shape with respect to the first imaginary line 551A. Likewise, the shape of the first wrapping portion 531 and the second wrapping portion 532 may be slightly different from the symmetric shape with respect to the second imaginary line 552A. This may be applied to the first through portion 541 and the second through portion 542, the first slit 541A and the second slit 542A, and the first slit 541B and the second slit 542B.

The length A1 of the indicator portion 52 in the orthogonal direction may be less than the length C1 of the slit 54B of the through portion 54 in the elongated direction. In this case, the user can more easily pass the indicator portion 52 through the slit 54A of the through portion 54. The length B1 of the wrapping portion 53 in the orthogonal direction may be less than the length D1 of the slit 54A of the through portion 54 in the orthogonal direction. This configuration can reduce bending of the wrapping portion 53 in the state in which the wrapping portion 53 passes through the through portion 54.

Holes may be formed instead of the slits 54A, 54B. The length of each of the holes in the elongated direction may be equal to or greater than the length A1 of the indicator portion 52 in the orthogonal direction. The length of each of the holes in the orthogonal direction may be equal to or greater than the length B1 of the wrapping portion 53 in the orthogonal direction.

The mount sheet 512 may have slits instead of the perforation 51Z. The substrate 511 need not have the frame portion 50. That is, only the labels 51 may be stuck to the mount sheet 512. In this case, the mount sheet 512 has: a first region at which the labels 51 are stuck to the mount sheet 512; and a second region at which the labels 51 are not stuck to the mount sheet 512. This configuration enables the user to easily peel off the label 51 from the mount sheet 512.

The first indicator portion 521 and the second indicator portion 522 only need to be at least partly symmetric with respect to the first imaginary line 551A. The first indicator portion 521 and the second indicator portion 522 may be different from each other in shape. The first wrapping portion 531 and the second wrapping portion 532 only need to be at least partly symmetric with respect to the second imaginary line 552A. The first wrapping portion 531 and the second wrapping portion 532 may be different from each other in shape. The first through portion 541 and the second through portion 542 only have to be at least partly symmetric with respect to the second imaginary line 552A. The first through portion 541 and the second through portion 542 may be different from each other in shape. The first slit 541A and the second slit 542A only have to be at least partly symmetric with respect to the second imaginary line 552A. Likewise, the first slit 541B and the second slit 542B only have to be at least partly symmetric with respect to the second imaginary line 552A. The first slit 541A and the second slit 542A may be different from each other in shape, and the first slit 541B and the second slit 542B may be different from each other in shape. The through portion 54 may have holes in addition to the slits 54A, MB.

The length of the wrapping portion 53 in the orthogonal direction may be the length A1 that is the length of each of the indicator portion 52 and the through portion 54 in the orthogonal direction. That is, the lengths of the indicator portion 52, the wrapping portion 53, and the through portion 54 in the orthogonal direction may be equal to each other. In this case, the first indicator portion 521, the first wrapping portion 531, and the first through portion 541 completely overlap each other in the first direction at their respective entire regions in the orthogonal direction. The second indicator portion 522, the second wrapping portion 532, and the second through portion 542 completely overlap each other in the first direction at their respective entire regions in the orthogonal direction.

In the first embodiment, the second line 552 may extend in a direction intersecting the orthogonal direction. In the second embodiment, the second line 852 may extend in a direction intersecting the elongated direction.

The overlapping portion 56 in the first embodiment may be provided on a second-direction-side end portion of the first indicator portion 521. In this case, in the case where the label 51 is bent along the first line 551 and the second line 552, the overlapping portion 56 may overlap the first-direction-side end portion of the first wrapping portion 531. The overlapping portion 86 in the second embodiment may be provided on the second-direction-side end portion of the first wrapping portion 831. In this case, in the case where the label 81 is bent along the second line 852, the overlapping portion 86 may overlap a portion of the second indicator portion 822. The overlapping portions 56, 86 may not be provided.

In the second embodiment, the through portion 84 may further have a slit extending in the orthogonal direction. The length of this slit in the orthogonal direction may be greater than or equal to the length of the wrapping portion 83 in the orthogonal direction. More preferably, the length of this slit in the orthogonal direction may be equal to the length of the wrapping portion 83 in the orthogonal direction.

The labels 51A, 51B, 51C, and so on may be arranged in the orthogonal direction. In the first embodiment, the first indicator portion 521, the second indicator portion 522, the second wrapping portion 532, the second through portion 542, the first through portion 541, and the first wrapping portion 531 may be arranged in this order in the orthogonal direction. In the second embodiment, the first indicator portion 821, the second indicator portion 822, the second wrapping portion 832, and the second through portion 842 may be arranged in this order in the orthogonal direction. Likewise, the first indicator portion 821, the second indicator portion 822, the first wrapping portion 831, and the first through portion 841 may be arranged in this order in the orthogonal direction. The labels 81A, 81B, 81C may be arranged in the orthogonal direction. Each of the first line 551 and the second line 552 is not limited to the perforation. For example, each of the first line 551 and the second line 552 may be a straight line or a broken line printed on the substrate 511 in advance.

In the first embodiment, the indicator portion 52 and each of the wrapping portion 53 and the through portion 54 may not overlap each other in the first direction. The first wrapping portion 531 and the first through portion 541 may not overlap each other in the first direction. The second wrapping portion 532 and the second through portion 542 may not overlap each other in the first direction. In the second embodiment, the first indicator portion 821 and the first wrapping portion 831 may not overlap each other in the first direction. The second indicator portion 822 and the second wrapping portion 832 may not overlap each other in the first direction.

In the second embodiment, only the first through portion 841 and the second through portion 842 may be connected to each other at the second line 852. In this case, the first wrapping portion 831 and the second wrapping portion 832 may not be connected to each other. Alternatively, only the first wrapping portion 831 and the second wrapping portion 832 may be connected to each other at the second line 852. In this case, the first through portion 841 and the second through portion 842 may not be connected to each other. Perforation extending in the orthogonal direction may be formed between the first wrapping portion 831 and the first through portion 841. Perforation extending in the orthogonal direction may be formed between the second wrapping portion 832 and the second through portion 842.

What is claimed is:

1. A label medium, comprising:

a mount sheet; and a label stuck to the mount sheet and comprising (i) a first indicator portion and a second indicator portion each comprising a region on which information is printable, (ii) a first wrapping portion and a second wrapping portion to be wrapped on a wrapped member, (iii) a first through portion comprising at least a portion of a first hole or a first slit through which the first indicator portion and the second indicator portion are passed, and (iv) a second through portion comprising at least a portion of a second hole or a second slit through which the first indicator portion and the second indicator portion are passed, wherein the first indicator portion and the second indicator portion are arranged in order of the first indicator portion and the second indicator portion in a first direction parallel with a surface of the mount sheet and opposed to a second direction, and the first indicator portion and the second indicator portion are connected to each other via a first line extending in a third direction orthogonal to the first direction, wherein the second indicator portion, the second wrapping portion, and the second through portion are connected to each other and arranged in order of the second indicator portion, the second wrapping portion, and the second through portion in the first direction, wherein the first wrapping portion and the first through portion are arranged in order of the first wrapping portion and the first through portion in one of the first direction and the second direction, wherein at least one of (a) a pair of the first wrapping portion and the second wrapping portion and (b) a pair of the first through portion and the second through portion are connected to each other via a second line, wherein at least a portion of the first indicator portion and at least a portion of the second indicator portion are symmetric with respect to a first imaginary line extending along the first line, wherein at least a portion of the first wrapping portion and at least a portion of the second wrapping portion are symmetric with respect to a second imaginary line extending along the second line, wherein at least a portion of the first through portion and at least a portion of the second through portion are symmetric with respect to the second imaginary line, wherein at least a portion of the first hole or the first slit and at least a portion of the second hole or the second slit are symmetric with respect to the second imaginary line, wherein the first wrapping portion is less than each of the first indicator portion and the first through portion in length in the third direction, and wherein the second wrapping portion is less than each of the second indicator portion and the second through portion in length in the third direction.

2. The label medium according to claim 1, wherein the second line extends in a direction parallel with the third direction.

3. The label medium according to claim 2, wherein, when viewed in the first direction, at least a portion of the first indicator portion, at least a portion of the second indicator portion, at least a portion of the first wrapping portion, at least a portion of the second wrapping portion, at least a portion of the first through portion, and at least a portion of the second through portion overlap each other.

4. The label medium according to claim 1, wherein the second line extends in a direction parallel with the first direction.

5. The label medium according to claim 4, wherein, when viewed in the first direction, at least a portion of the first indicator portion and at least a portion of the first wrapping portion overlap each other, and wherein, when viewed in the first direction, at least a portion of the second indicator portion and at least a portion of the second wrapping portion overlap each other.

6. The label medium according to claim 1, wherein an overlapping portion is provided on the first wrapping portion, and the overlapping portion overlaps at least a portion of each of the first indicator portion and the second indicator portion when the label is bent along the first line and the second line.

7. The label medium according to claim 1, wherein an overlapping portion is provided on the first indicator portion, and the overlapping portion overlaps at least a portion of each of the first wrapping portion and the second wrapping portion when the label is bent along the first line and the second line.

8. The label medium according to claim 1, wherein a length of the first indicator portion in the third direction is less than or equal to a length of the first hole or the first slit in the first direction, and wherein a length of the second indicator portion in the third direction is less than or equal to a length of the second hole or the second slit in the first direction.

9. The label medium according to claim 8, wherein the length of the first hole or the first slit in the first direction is equal to the length of the first indicator portion in the third direction, and wherein the length of the second hole or the second slit in the first direction is equal to the length of the second indicator portion in the third direction.

10. The label medium according to claim 1, wherein a length of the first wrapping portion in the third direction is less than or equal to a length of the first hole or the first slit in the third direction, and wherein a length of the second wrapping portion in the third direction is less than or equal to a length of the second hole or the second slit in the third direction.

11. The label medium according to claim 10, wherein the length of the first hole or the first slit in the third direction is equal to the length of the first wrapping portion in the third direction, and wherein the length of the second hole or the second slit in the third direction is equal to the length of the second wrapping portion in the third direction.

12. The label medium according to claim 1, wherein adhesive is provided between the mount sheet and the label.

13. The label medium according to claim 1, wherein the mount sheet has an elongated shape, wherein the label medium further comprises a plurality of labels each as the label which are arranged in an elongated direction of the mount sheet and stuck to the mount sheet, and wherein the elongated direction of the mount sheet is parallel with the first direction.

14. The label medium according to claim 1, wherein each of the first line and the second line is a perforation.

15. The label medium according to claim 1, wherein the first indicator portion and the second indicator portion have an identical shape and an identical size, wherein the first wrapping portion and the second wrapping portion have an identical shape and an identical size, and wherein the first through portion and the second through portion have an identical shape and an identical size.

16. The label medium according to claim 1, wherein, when viewed in the first direction, the first wrapping portion and at least a portion of the first hole or the first slit overlap each other, and wherein, when viewed in the first direction, the second wrapping portion and at least a portion of the second hole or the second slit overlap each other.

17. A cassette containing a roll that is formed by winding a label medium around a spool, wherein the label medium comprises:

a mount sheet; and a label stuck to the mount sheet and comprising (i) a first indicator portion and a second indicator portion each comprising a region on which information is printable, (ii) a first wrapping portion and a second wrapping portion to be wrapped on a wrapped member, (iii) a first through portion comprising at least a portion of a first hole or a first slit through which the first indicator portion and the second indicator portion are passed, and (iv) a second through portion comprising at least a portion of a second hole or a second slit through which the first indicator portion and the second indicator portion are passed, wherein the first indicator portion and the second indicator portion are arranged in order of the first indicator portion and the second indicator portion in a first direction parallel with a surface of the mount sheet and opposed to a second direction, and the first indicator portion and the second indicator portion are connected to each other via a first line extending in a third direction orthogonal to the first direction, wherein the second indicator portion, the second wrapping portion, and the second through portion are connected to each other and arranged in order of the second indicator portion, the second wrapping portion, and the second through portion in the first direction, wherein the first wrapping portion and the first through portion are arranged in order of the first wrapping portion and the first through portion in one of the first direction and the second direction, wherein at least one of (a) a pair of the first wrapping portion and the second wrapping portion and (b) a pair of the first through portion and the second through portion are connected to each other via a second line, wherein at least a portion of the first indicator portion and at least a portion of the second indicator portion are symmetric with respect to a first imaginary line extending along the first line, wherein at least a portion of the first wrapping portion and at least a portion of the second wrapping portion are symmetric with respect to a second imaginary line extending along the second line, wherein at least a portion of the first through portion and at least a portion of the second through portion are symmetric with respect to the second imaginary line, wherein at least a portion of the first hole or the first slit and at least a portion of the second hole or the second slit are symmetric with respect to the second imaginary line, wherein the first indicator portion, the second indicator portion, the second wrapping portion, and the second through portion are arranged in order of the first indicator portion, the second indicator portion, the second wrapping portion, and the second through portion in a direction directed from one of opposite ends of the label medium, which is connected to the spool, toward the other of the opposite ends of the label medium, wherein the first wrapping portion is less than each of the first indicator portion and the first through portion in length in the third direction, and wherein the second wrapping portion is less than each of the second indicator portion and the second through portion in length in the third direction.

18. A label medium, comprising:

a mount sheet; and a label stuck to the mount sheet and comprising (i) a first indicator portion and a second indicator portion each comprising a region on which information is printable, (ii) a first wrapping portion and a second wrapping portion to be wrapped on a wrapped member, (iii) a first through portion comprising at least a portion of a first hole or a first slit through which the first indicator portion and the second indicator portion are passed, and (iv) a second through portion comprising at least a portion of a second hole or a second slit through which the first indicator portion and the second indicator portion are passed, wherein the first indicator portion and the second indicator portion are arranged in order of the first indicator portion and the second indicator portion in a first direction parallel with a surface of the mount sheet and opposed to a second direction, and the first indicator portion and the second indicator portion are connected to each other via a first line extending in a third direction orthogonal to the first direction, wherein the second indicator portion, the second wrapping portion, and the second through portion are connected to each other and arranged in order of the second indicator portion, the second wrapping portion, and the second through portion in the first direction, wherein the first wrapping portion and the first through portion are arranged in order of the first wrapping portion and the first through portion in one of the first direction and the second direction, wherein at least one of (a) a pair of the first wrapping portion and the second wrapping portion and (b) a pair of the first through portion and the second through portion are connected to each other via a second line, wherein at least a portion of the first indicator portion and at least a portion of the second indicator portion are symmetric with respect to a first imaginary line extending along the first line, wherein at least a portion of the first wrapping portion and at least a portion of the second wrapping portion are symmetric with respect to a second imaginary line extending along the second line, wherein at least a portion of the first through portion and at least a portion of the second through portion are symmetric with respect to the second imaginary line, wherein at least a portion of the first hole or the first slit and at least a portion of the second hole or the second slit are symmetric with respect to the second imaginary line, and wherein each of the first line and the second line is a perforation.

19. A label medium, comprising:

a mount sheet; and a label stuck to the mount sheet and comprising (i) a first indicator portion and a second indicator portion each comprising a region on which information is printable, (ii) a first wrapping portion and a second wrapping portion to be wrapped on a wrapped member, (iii) a first through portion comprising at least a portion of a first hole or a first slit through which the first indicator portion and the second indicator portion are passed, and (iv) a second through portion comprising at least a portion of a second hole or a second slit through which the first indicator portion and the second indicator portion are passed, wherein the first indicator portion and the second indicator portion are arranged in order of the first indicator portion and the second indicator portion in a first direction parallel with a surface of the mount sheet and opposed to a second direction, and the first indicator portion and the second indicator portion are connected to each other via a first line extending in a third direction orthogonal to the first direction, wherein the second indicator portion, the second wrapping portion, and the second through portion are connected to each other and arranged in order of the second indicator portion, the second wrapping portion, and the second through portion in the first direction, wherein the first wrapping portion and the first through portion are arranged in order of the first wrapping portion and the first through portion in one of the first direction and the second direction, wherein at least one of (a) a pair of the first wrapping portion and the second wrapping portion and (b) a pair of the first through portion and the second through portion are connected to each other via a second line, wherein at least a portion of the first indicator portion and at least a portion of the second indicator portion are symmetric with respect to a first imaginary line extending along the first line, wherein at least a portion of the first wrapping portion and at least a portion of the second wrapping portion are symmetric with respect to a second imaginary line extending along the second line, wherein at least a portion of the first through portion and at least a portion of the second through portion are symmetric with respect to the second imaginary line, wherein at least a portion of the first hole or the first slit and at least a portion of the second hole or the second slit are symmetric with respect to the second imaginary line, wherein the first indicator portion and the second indicator portion have an identical shape and an identical size, wherein the first wrapping portion and the second wrapping portion have an identical shape and an identical size, and wherein the first through portion and the second through portion have an identical shape and an identical size.

* * * * *